US007111376B2

(12) United States Patent
Lombardi et al.

(10) Patent No.: US 7,111,376 B2
(45) Date of Patent: Sep. 26, 2006

(54) TOOL WITH INSERTED BLADE MEMBERS

(75) Inventors: Keith M. Lombardi, Farmington, CT (US); David Workman, Dublin, OH (US); Stephen R. Crosby, Broad Brook, CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 10/662,457

(22) Filed: Sep. 16, 2003

(65) Prior Publication Data

US 2004/0133989 A1 Jul. 15, 2004

Related U.S. Application Data

(60) Provisional application No. 60/439,470, filed on Jan. 13, 2003.

(51) Int. Cl.
*B23P 19/04* (2006.01)
*B23D 63/02* (2006.01)
*B25B 7/02* (2006.01)

(52) U.S. Cl. ..... 29/428; 29/268; 29/248; 29/505; 76/64; 81/421

(58) Field of Classification Search ..... 29/248, 29/268, 242, 243, 526.3, 521, 505, 428; 76/64; 81/421
See application file for complete search history.

(56) References Cited

U.S. PATENT DOCUMENTS

| | | | | |
|---|---|---|---|---|
| 496,584 | A | 5/1893 | Taft | |
| 512,461 | A * | 1/1894 | Walter | 433/1 |
| 1,177,303 | A | 3/1916 | Carski | |
| 1,373,555 | A * | 4/1921 | Graham | 7/133 |
| 1,508,687 | A * | 9/1924 | Gilley | 7/133 |
| 1,538,028 | A | 5/1925 | Davis | |
| 2,529,949 | A * | 11/1950 | Jones et al. | 30/186 |
| 2,597,394 | A * | 5/1952 | Snowden | 606/147 |
| 3,774,301 | A | 11/1973 | Brown | |
| 3,791,013 | A | 2/1974 | Rogers | |
| 4,653,373 | A | 3/1987 | Gerber | |
| 4,981,756 | A | 1/1991 | Rhandhawa | |
| 5,033,195 | A | 7/1991 | Appelkvist et al. | |
| 5,301,431 | A | 4/1994 | Cera | |
| 5,452,705 | A | 9/1995 | Horng | |
| 5,485,641 | A * | 1/1996 | Machmeier et al. | 7/134 |
| 6,116,360 | A | 9/2000 | Evans | |
| 6,324,712 | B1 | 12/2001 | Elsener, Sr. | |
| 6,725,546 | B1 * | 4/2004 | Dallas et al. | 30/193 |

FOREIGN PATENT DOCUMENTS

DE 25 29 305 7/1975

(Continued)

OTHER PUBLICATIONS

Keiba Tools Catalogue, vol. 76, pp. 29 and 35.

*Primary Examiner*—Essama Omgba
(74) *Attorney, Agent, or Firm*—Pillsbury Winthrop Shaw Pittman LLP

(57) ABSTRACT

A tool includes first and second elongated members, each member having a handle portion at one end and a jaw portion at an opposite end. Intermediate portions of the members are movably coupled to one another. Movement of the handle portions opens and closes the jaw portions. Each jaw portion includes a gripping surface configured to grip a workpiece. A pair of blade members are rigidly secured to the jaw portions, each blade member having a cutting edge.

45 Claims, 13 Drawing Sheets

FOREIGN PATENT DOCUMENTS

| | | | |
|---|---|---|---|
| DE | 31 00 673 | A1 | 8/1982 |
| DE | 90 02 893.7 | | 8/1990 |
| EP | 0 207 071 | A1 | 12/1986 |
| EP | 0 371 363 | A1 | 6/1990 |
| EP | 0 497 508 | A2 | 8/1992 |
| GB | 110214 | | 10/1917 |
| GB | 738298 | | 10/1955 |
| GB | 2 175 835 | A | 12/1986 |
| GB | 2175835 | * | 12/1986 |
| GB | 2 351 254 | A | 12/2000 |
| JP | 55-86636 | | 6/1980 |
| JP | 57-71780 | | 5/1982 |
| JP | 60-99449 | | 6/1985 |
| JP | 1-164527 | | 6/1989 |
| JP | 1-257571 | | 10/1989 |
| JP | 2-74281 | | 3/1990 |
| JP | 4-285580 | | 10/1992 |
| JP | 7-223171 | | 8/1995 |
| JP | 8-299620 | | 11/1996 |
| JP | 8-309679 | | 11/1996 |
| JP | 8-311586 | | 11/1996 |
| JP | 10-146377 | | 6/1998 |
| JP | 2000-71177 | | 3/2000 |
| JP | 2000-316442 | | 11/2000 |
| JP | 2002-120158 | | 4/2002 |
| WO | WO 01/10610 | A1 | 2/2001 |

* cited by examiner

REGULAR BEVEL

COMPOUND

HOLLOW GROUND

PARABOLIC

TOOL WITH INSERTED BLADE MEMBERS

The present application claims priority to U.S. Provisional Application of Lombardi et al., Jan. 13, 2003 Ser. No. 60/439,470, the entirety of which is hereby incorporated into the present application by reference.

FIELD OF THE INVENTION

The present invention relates to cutting tools and to methods of making cutting tools. Illustrative embodiments of the present invention relate to hand tools which include cutting edges operable to cut workpieces, and to methods for making the same.

BACKGROUND

Many types of tools, including many types of hand tools, incorporate cutting edges for cutting various types of workpieces. For example, hand tools having a pliers-type of construction may include cutting edges. Pliers-type hand tools generally include a pair of elongated integral members (or pliers "halves") each having a handle portion at one end and a jaw portion at an opposite end. The elongated members are pivotally connected to one another such that when the handle portions are opened and closed, the jaws open and close. Each jaw may be shaped to include an integral cutting edge along all of its length (e.g., a pair of dedicated wire cutters) or along a portion of its length (e.g., a pair of pliers that include cutting edges).

Conventional pliers that include cutting edges are difficult and expensive to manufacture. Each pliers half is an integral metal structure that is initially formed in a metal forging operation. After forging, each pliers half is machined to further shape and define various pliers features, including roughly machining in an integral cutting edge in each pliers half. Enough metallic material is left in the cutting edge area of each jaw to allow further shaping of the integral cutting edge. The two pliers halves are then movably connected to one another by, for example, pivotally connecting the halves to one another with a center rivet.

When machining the cutting edge in each pliers half, the machining process generates a recess or pocket on the back side of the cutting blade. FIG. 27 illustrates a known pliers half having a recess or pocket 240 on the back side of the cutting blade 250. When using these known pliers, the scrap material of the item being cut often gets caught in this recess or pocket 240 which requires the user to turn the pliers over so that the scrap material can fall out or be shaken out. If this scrap material is not removed from the recess or pocket 240, this scrap material can have an adverse affect on the next cutting operation. One aspect of the present invention is to provide pliers that prevent the possibility of scrap material adversely affecting subsequent cutting operations.

The metal of the pliers is then treated by, for example, heat treating the metal, to increase the metal hardness. Metal hardness may be increased from 35 Rockwell C Hardness (or "HRC") to 50 HRC, for example, to make the metal strong enough to withstand everyday use. The amount of hardness increase depends on several factors including, the type of pliers being constructed and the types of jobs for which the pliers will be used. During heat treatment, the metal of the pliers moves and may become distorted.

The movement and/or distortion of the metal may be especially pronounced in hand tools that are long and thin and that have intricately machined features, such as pliers. Consequently, after heat treatment, the pliers are shaped and/or straightened to, for example, assure that the handle portions and jaw portions are properly shaped and properly aligned with one another. During this shaping process, the cutting edges are brought back into rough alignment with one another. This shaping and straightening is done manually by skilled labor and is therefore time consuming and expensive.

The cutting edges are then further shaped and aligned with one another by filing off some of the excess material in the cutting edge area of each jaw portion. This operation is often done manually by a skilled worker using a hand file or a fine grinding wheel. The two halves must be carefully shaped so that the cutting edges meet perfectly when the jaws of the pliers are in their closed position. If too much material is removed, the pliers are ruined. Each cutting edge must be filed/ground to have a sharp edge and so that when jaws are closed, the cutting edges are immediately adjacent one another or abut one another. When the cutting edges are shaped manually, the exact shape and quality of each cutting edge varies from one pair of pliers to the next. Manually-shaped cutting edges are also limited to having a simple bevel (when viewed in cross-section or "profile"). This edge configuration is not the best for all cutting applications. Most of the labor cost involved in the manufacture of pliers is incurred during the manual shaping operation in which the cutting edge of each pliers jaw is shaped.

After the cutting edges are filed/ground, the cutting edges are heat treated to increase the hardness of the cutting edges. The cutting edges may, for example, be treated to have a hardness of between 55 HRC and 65 HRC. These hardness values are outlined in the standards established by the American Society of Mechanical Engineers (ASME). The entire body of the pliers should not be hardened to this degree, however, because that would make the body of the pliers too brittle. Often the cutting edges are hardened using an induction heat treatment operation. During this operation, the cutting edges and a portion of the metallic material surrounding the cutting edges are heated rapidly using a localized heat source. When the cutting edges reach the desired temperature, they are quenched which increases the hardness of the cutting edges. This heat treating operation can be imprecise, however, and may result in each cutting edge having a variable hardness along its length or may harden the metallic material surrounding the cutting edges to a degree which renders the pliers prone to cracking, particularly if the metallic material of a pliers body is excessively hardened in the area of the pivot joint because the pivot joint area is highly stressed during operation of the pliers. After the blades are quenched during hardening, they are then tempered for toughness.

It can be appreciated that cutting edges formed in pliers made using conventional methods require extensive hand labor, are of inconsistent quality and are otherwise inherently limited. In general, pliers with good quality cutting edges are difficult, time consuming and expensive to produce using conventional methods. The mark of good quality cutting pliers is the ability of the pliers to cut bond paper cleanly when the paper is positioned anywhere along the cutting edges of the hand tool. This test is specified in ASME specifications and in other world standards for hand tools. This test indicates how accurately the cutting edges meet when the jaws are in their closed position. Perfectly matched cutting edges are important for cutting soft wire such as copper and for cutting fine strands of wire such as those found in lamp cords. The cutting edges of pliers formed by conventional methods are also limited due to cost to having a simple bevel shape. This shape is not necessarily the best cutting edge shape for a particular material or application.

Another test that indicates how accurately the cutting edges meet when the jaws are in their closed position is a light test. Specifically, light passing through the closed pliers cutting edges is viewed as a defect detrimental to cutting performance. That is, even the slightest deviation from straight in the cutting edges manifests itself as visible light when the jaws are closed and held up to the light. For example, FIGS. 22 and 23 illustrate pliers having a single cutting blade 260 that works cooperatively with an anvil 270 on an opposing jaw. The cutting edges of the blade 260 and anvil 270 are not perfectly straight due to typical manufacturing deviations, which allows light to pass between the edge of the blade 260 and the anvil 270. One aspect of the present invention is to provide pliers that reduces the possibility of light passing through cutting edges of pliers when they are closed together.

Generally, each cutting edge must be sharp and must be formed of a material that is hard enough to resist either plastic or permanent deformation under stress and to resist wear by abrasion. If, for example, the cutting edges become permanently deformed during a cutting operation, this deformation makes the cutting edges permanently dull which impairs cutting ability. Therefore, a hard material should be used to construct the cutting edges. The entire body of conventional pliers is made of a single material, however. A cutting edge made of a hard metallic material such as a highly alloyed steel, for example, will cut well, but a hand tool constructed entirely of a highly alloyed steel is expensive and is not commercially feasible. In addition, it may not be possible or desirable to make an entire hand tool such as a pair of pliers with a material that is optimized for forming a cutting edge because of the processing limits of the material. Therefore, manufacturers of pliers and other hand tools that include integral cutting edges must often compromise between selecting the best material for a cutting edge and selecting a cost effective material.

There is always a need in the tool making industries to improve tool quality and to lower production costs.

SUMMARY

The present invention may be embodied in a tool for working on a workpiece, the tool comprising a longitudinal tool body comprising first and second elongated longitudinal members, each member being constructed of a metallic material and each having a handle portion at one end and a jaw portion at an opposite end. Intermediate portions of the first and second members are movably coupled to one another for pivotal movement about a pivot axis such that movement of the handle portions from an open position in which the handle portions are relatively far apart from one another to a closed position in which the handle portions are relatively close to one another moves the jaw portions from an open position in which the jaw portions are spaced relatively far apart from one another to a closed position in which the jaw portions are relatively close to one another and such that movement of the handle portions away from one another moves the jaw portions away from one another. Each jaw portion has a gripping surface configured such that when the jaw portions are in an open position, the gripping surfaces are relatively far apart from one another to enable a workpiece to be positioned therebetween and such that when the jaw portions are in their closed position the gripping surfaces are relatively close one another. The tool body is constructed and arranged to enable the gripping surfaces to apply generally opposing gripping forces to a workpiece by positioning the workpiece between the gripping surfaces when the jaw portions are in their open position and moving the jaw portions toward their closed position. Each jaw portion includes a slot extending from one side of an associated jaw portion to an opposite side of an associated jaw portion, each slot having a pair of open opposite ends, the slots being constructed and arranged such that when the jaw portions are in their closed position, the slots are transversely aligned with one another and cooperate with one another to form a substantially continuous transverse slot that extends from one side of the tool body to an opposite side of the tool body. The tool also includes a pair of separate blade members, each blade member having a cutting edge portion providing a cutting edge that is radially aligned with the pivot axis and is constructed of a metallic material that is harder than the metallic material used to construct the elongated members. Each blade member is rigidly secured within a respective one of the slots such that (a) when the jaw portions are in their closed position, the cutting edges are disposed in abutting relation to one another, such that (b) when the jaw portions are in their open position the cutting edges are spaced apart from one another to enable a workpiece to be positioned therebetween, and (c) such that when a workpiece is positioned between the cutting edges and the jaw portions are moved toward their closed position, the cutting edges cut the workpiece.

The invention may also be embodied in a cutting tool for cutting a workpiece, the tool comprising a longitudinal tool body comprising first and second elongated longitudinal members, each member being constructed of a metallic material and each having a handle portion at one end and a jaw portion at an opposite end. Intermediate portions of the first and second members are movably coupled to one another for pivotal movement about a pivot axis such that movement of the handle portions from an open position in which the handle portions are relatively far apart from one another to a closed position in which the handle portions are relatively close to one another moves the jaw portions from an open position in which the jaw portions are spaced relatively far apart from one another to a closed position in which the jaw portions are relatively close to one another and such that movement of the handle portions away from one another moves the jaw portions away from one another. The cutting tool further includes a pair of separate blade members each having a cutting edge, each blade member being rigidly secured to a respective one of the jaw portions such that the cutting edge thereof extends radially with respect to the pivot axis and such that when the jaw portions are in their closed position the cutting edges are disposed in abutting relation to one another and when the jaw portions are in their open position the cutting edges are spaced apart from one another to enable a workpiece to be positioned therebetween so that when a workpiece is positioned between the cutting edges and the jaw portions are moved toward their closed position, the cutting edges cut the workpiece.

The invention may also be embodied in a tool for working on a workpiece, the tool comprising a longitudinal tool body comprising first and second elongated longitudinal members, each member being constructed of a metallic material and each having a handle portion at one end and a jaw portion at an opposite end. Intermediate portions of the first and second members are movably coupled to one another for pivotal movement about a pivot axis such that movement of the handle portions from an open position in which the handle portions are relatively far apart from one another to a closed position in which the handle portions are relatively close to one another moves the jaw portions from an open position in which the jaw portions are spaced relatively far apart from one another to a closed position in which the jaw portions are relatively close to one another and such that movement of the handle portions away from one another moves the jaw portions away from one another. Each jaw portion has a gripping surface configured such that when the jaw portions are in an open position, the gripping surfaces are relatively far apart from one another to enable a workpiece to be positioned therebetween and such that when the jaw portions are in their closed position the gripping surfaces are relatively close one another. The tool body is constructed and arranged to enable the gripping surfaces to apply generally opposing gripping forces to a workpiece by positioning the workpiece between the gripping surfaces when the jaw portions are in their open position and moving the jaw portions toward their closed position. The tool includes a pair of separate blade members each mounted on a respective one of the jaw portions. Each blade member has a cutting edge portion and a backing portion. The cutting edge portion of each blade member provides a cutting edge that is radially aligned with the pivot axis and is constructed of a first metallic material that is harder than the metallic material used to construct the elongated members. Each blade member is rigidly secured to a respective one of the jaw portions such that (a) when the jaw portions are in their closed position, the cutting edges are disposed in abutting relation to one another, such that (b) when the jaw portions are in their open position the cutting edges are spaced apart from one another to enable a workpiece to be positioned therebetween, and (c) such that when a workpiece is positioned between the cutting edges and the jaw portions are moved toward their closed position, the cutting edges cut the workpiece.

The invention may also be embodied in a method of making a tool, the method comprising providing a pair of blade members and a tool body, each blade member being constructed of one or more metallic materials and each having a backing portion and a cutting edge portion providing a cutting edge, the tool body comprising a pair of first and second elongated members, each member being an integral structure constructed of a metallic material and having a handle portion at one end and a jaw portion at an opposite end, each jaw portion having one or more welding projections, intermediate portions of the elongated members being coupled to one another for movement about a pivot axis such that movement of the handle portions from an open position to a closed position moves the jaw portions from an open position in which the jaw portions are relatively far apart from one another to a closed position in which the jaw portions are relatively close to one another and movement of the handle portions toward their open position moves the jaw portions away from one another. The method includes welding a blade member to the jaw portion of each elongated member by (a) placing each blade member in contact with each projection on a respective jaw portion and (b) applying electrical current and force to the tool body and the blade members, the applied electrical current flowing through each projection and the associated blade member and establishing a sufficient current density in each projection to heat each projection sufficiently to cause the metallic material of each projection to soften and the force moving each blade member and softened metallic material from each projection toward the associated jaw portion thereby forming a welded connection between each blade member and a respective jaw portion of the tool body, each blade member being secured to the tool body such that when the jaw portions are in their open position, the cutting edges of the blade members are spaced apart from one another and such that when the jaw portions are in their closed position, the cutting edges of the blade members are in abutting relation to one another.

The invention may also be embodied in a method of making a tool, the method comprising forming first and second elongated longitudinal members, each member being an integral structure constructed of a metallic material and having a handle portion at one end and a jaw portion at an opposite end, each jaw portion having a gripping surface; forming a longitudinal tool body by connecting intermediate portions of the elongated members to one another for pivotal movement about a pivot axis such that movement of the handle portions from an open position to a closed position moves the jaw portions from an open position in which the gripping surfaces are relatively far apart from one another to a closed position in which the gripping surfaces are relatively close to one another and movement of the handle portions toward their open position moves the jaw portions away from one another, the connected elongated members being constructed and arranged to enable the gripping surfaces to apply generally opposing gripping forces to a workpiece by positioning the workpiece between the gripping surfaces when the jaw portions are in their open position and moving the jaw portions toward their closed position; forming a substantially continuous transverse slot that extends from one side of the tool body to an opposite side of the tool body when the jaw portions are in their closed position, the substantially continuous slot comprising a transverse slot formed in each jaw portion, the slot in each jaw portion extending from one side of an associated jaw portion to an opposite side of an associated jaw portion and the slots in the jaw portions being transversely aligned with one another to form the substantially continuous slot in the tool body, the slot in each jaw portion including one or more integral projections; providing a pair of blade members, each blade member having a cutting edge portion providing a cutting edge, each blade member being constructed of one or more metallic materials; welding a blade member to the jaw portion of each elongated member by (a) placing each blade member in contact with each projection on a respective jaw portion and (b) applying electrical current and force to the tool body and the blade members, the applied electrical current flowing through each projection and the associated blade member and establishing a sufficient current density in each projection to heat each projection sufficiently to cause the metallic material of each projection to soften and the force moving each blade member and softened metallic material from each projection toward the associated jaw portion and into a respective slot thereby forming a welded connection between each blade member and a respective jaw portion of the tool body, each blade member being welded to a respective jaw portion such that when the jaw portions are in their open position, the cutting edges of the blade members are spaced apart from one another and such that when the jaw portions are in their closed position, the cutting edges of the blade members are in abutting relation to one another.

The invention may also be embodied in a method of making a tool, the method comprising providing a pair of blade members and a tool body, each blade member being constructed of one or more metallic materials and having a cutting edge, the tool body comprising a pair of first and second elongated members, each member being an integral structure constructed of a metallic material and having a handle portion at one end and a jaw portion at an opposite end, each jaw portion having a gripping surface and one or more welding projections, intermediate portions of the elongated members being coupled to one another for movement about a pivot axis such that movement of the handle portions from an open position to a closed position moves the jaw portions from an open position in which the gripping surfaces are relatively far apart from one another to a closed position in which the gripping surfaces are relatively close to one another and movement of the handle portions toward their open position moves the gripping surfaces away from one another to enable the gripping surfaces to apply generally opposing gripping forces to a workpiece by positioning the workpiece between the gripping surfaces when the jaw portions are in their open position and moving the jaw portions toward their closed position; welding a blade member to the jaw portion of each elongated member by (a) placing the jaw portions of the tool body in their closed position, (b) positioning the blade members such that each blade member is in contact with each projection on a respective jaw portion and such that the cutting edges of the blade members are in abutting relation to one another and (c) applying electrical current and force to the tool body and the blade members, the electrical current being applied utilizing a first electrode in contact with the blade members and a second electrode in contact with the tool body, the applied electrical current flowing through each projection and the associated blade member and establishing a sufficient current density in each projection to cause the metallic material of each projection to soften and the force being applied utilizing the first electrode, the first electrode being operable to move each blade member and metallic material from each projection toward the associated jaw portion thereby forming a welded connection between each blade member and a respective jaw portion of the tool body and to maintain the cutting edges of the blade members in abutting relation as each welded connection is formed so that when the jaw portions are in their closed position, the cutting edges of the blade members are in abutting relation to one another.

The invention may also be embodied in a method of welding a workpiece engaging structure to a tool body, the workpiece engaging structure being constructed of at least one metallic material and having a workpiece engaging portion constructed of a relatively harder material, and the tool body being constructed of a relatively softer metallic material. The method includes providing the workpiece engaging structure constructed of at least one metallic material and having the workpiece engaging portion. The workpiece engaging structure includes a backing portion and the workpiece engaging portion is secured to the backing portion. The method further includes providing the tool body constructed of the relatively softer metallic material and having one or more projections projecting integrally outwardly from a surface thereof. The method further includes placing the backing portion of the workpiece engaging structure in contact with each projection on the tool body and applying electrical current and force to the tool body and the workpiece engaging structure. The applied electrical current flows between the tool body and the workpiece engaging structure through each projection and establishes a sufficient current density in each projection to heat each projection sufficiently to cause the metallic material of each projection to soften. The force moves the workpiece engaging structure and softened metallic material of each projection toward the tool body thereby forming a welded connection between the workpiece engaging structure and the tool body. Each projection and the workpiece engaging structure is constructed and arranged such that the applied electrical current heats the projections sufficiently to soften the metallic material of each projection to enable the welded connection to be formed without heating the workpiece engaging portion of the workpiece engaging structure to a degree that would substantially affect the hardness of the workpiece engaging portion of the workpiece engaging structure. The backing portion of the workpiece engaging structure may include the projections instead of the tool body.

Other aspects, features, and advantages of the present invention will become apparent from the following detailed description of the illustrated embodiments, the accompanying drawings, and the appended claims.

DETAILED DESCRIPTION

The principles of the present invention have a wide range of applicability. For example, some of the principles of the invention can be applied to the construction of tools (e.g., hand tool) and machinery. One aspect of the present invention, for example, describes methods for welding a metallic structure constructed of a relatively harder metallic material (or that includes a portion that is constructed of a relatively harder metallic material) to the body of a tool constructed of a relatively softer metallic material without substantially compromising or degrading the physical properties or characteristics (e.g., the hardness) of the relatively harder structure during the welding process. This aspect of the invention may be used to secure one or more cutting structures (e.g., cutting blades) to a tool body, for example, or to secure one or more structures (e.g., structures having gripping faces or surfaces that contact and act on a workpiece when the tool is in use) to a tool body that may function, for example, to grip, crimp, process, shape, or otherwise act on a workpiece.

Figure 1:
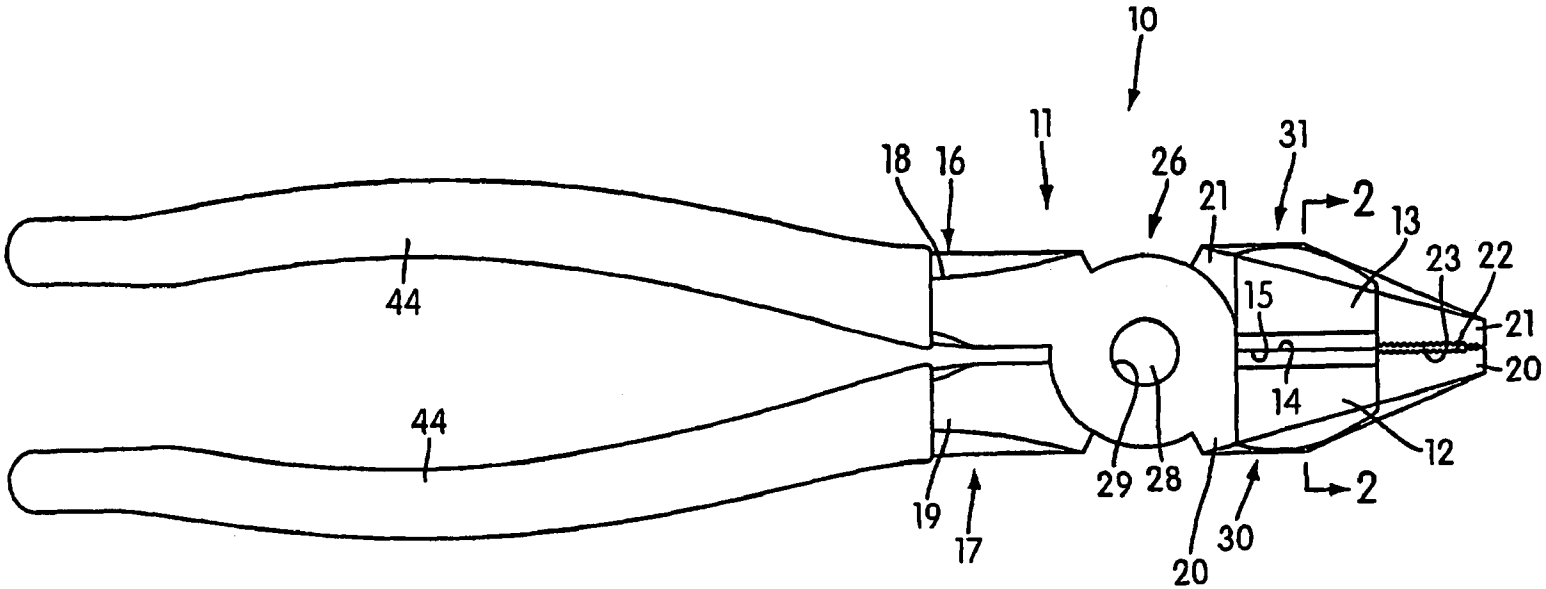
FIG. 1 shows an illustrative embodiment of a hand tool constructed according to principles of the present invention.

Some of the principles of the invention are described by illustrating ways of attaching a cutting blade constructed of a relative harder metallic material to a tool body constructed of a relatively softer metallic material. FIG. 1 shows an illustrative embodiment of a pair of pliers 10, but the principles of the invention are not limited to pliers, to hand tools, to methods of attaching blades to tools or to structures that include one or more blades. Thus, while the principles of the invention can be used to construct a wide range of tools, including a wide range of hand tools, that include one or more cutting edges (e.g., single blade cutting tools such as chisels or two blade cutting tools such as pliers or dedicated wire cutters) that are used to cut various types of workpieces, the invention is not limited to tools or machines that include one or more blades or cutting edges.

The pliers 10 include a pair of elongated longitudinal members 16, 17 that are pivotally connected to one another to form the body 11 of the pliers 10. A pair of blade members 12, 13 are rigidly secured to the body 11 of the pliers 10, each blade member 12, 13 being secured to a respective elongated member 16, 17. Each blade member 12, 13 has a cutting edge 14, 15 which can be used to cut various workpieces (e.g., various types and sizes of wire). The blade members 12, 13 may be constructed of a metallic material that is different from the metallic material used to construct the body 11 of the pliers 10. For example, the body of the pliers 10 may be constructed of a metallic material that is relatively inexpensive and less hard than the metallic material used to construct the blade members 12, 13 and the blade members 12, 13 may each be constructed of a metallic material that is hard (e.g., a tool steel or other alloy) relative to the metallic material of the tool body 11 to maximize the durability and the cutting performance of the cutting edges 14, 15.

Each elongated member 16, 17 includes, respectively, a handle portion 18, 19 at one end portion thereof and a jaw portion 20, 21 at an opposite end portion thereof. The elongated members 16, 17 of the illustrative embodiment are of substantially identical construction to one another so certain structural details may be discussed with reference to the elongated member 16 alone, but the discussion applies equally to the elongated member 17.

A respective gripping surface 22, 23 is formed on the jaw portion 20, 21 of each elongated member 16, 17. The gripping surfaces 22, 23 may be used to grip a workpiece. Intermediate portions of each elongated member 16, 17 are movably coupled to one another at a joint 26. It can be appreciated that the joint 26 can have a wide range of constructions and can be disposed in a wide range of locations. The joint 26 is formed between intermediate portions of the elongated members 16, 17, but this is illustrative only and not intended to be limiting. More specifically, in the illustrative pair of pliers 10, the elongated members 16, 17 are pivotally mounted to one another at the joint 26 by a rivet 28. An opening 29 is formed in the intermediate portion of each elongated member 16, 17 and the rivet 28 extends through and is secured within the aligned openings 29 of the elongated members 16, 17. This method of pivotally connecting the elongated members 16, 17 to one another is intended as an example only and is not intended to limit the manner in which the elongated members 16, 17 may be movably coupled to one another. The elongated members 16, 17 may be movably coupled to one another in any appropriate manner using any appropriate mechanism.

When the pliers 10 are in their closed position, the jaw portions 20 are on one side of the joint 26 and the handle portions 18 are on an opposite side of the joint 26. This construction is illustrative, however, and not intended to limit the scope of the invention. For example, the gripping surfaces or another pair of gripping surfaces could be disposed on the same side of the joint 26 as the handle portions 18. In the illustrative embodiment, the elongated members 16, 17 are movably coupled to one another such that (a) movement of the handle portions 18, 19 from an open position in which the handle portions 18, 19 are relatively far apart from one another to a closed position in which the handle portions 18, 19 are relatively close to one another moves the jaw portions 20, 21 from an open position in which the jaw portions 20, 21 are spaced apart from one another to a closed position in which the jaw portions 20, 21 are adjacent to one another. Movement of the handle portions 18, 19 away from one another moves the jaw portions 20, 21 away from one another.

The illustrative embodiment of the pliers 10 is configured such that when the jaw portions 20, 21 are in an open position, the gripping surfaces 22, 23 are spaced relatively far apart from one another to enable a workpiece to be positioned therebetween and such that when the jaw portions 20, 21 are in their closed position, the gripping surfaces 22, 23 are in contact with one another. Other embodiments of the pliers 10 may be constructed such that when the jaw portions are in their closed position, the gripping surfaces 22, 23 are relatively close to one another but are slightly spaced from one another. When a workpiece is positioned between the gripping surfaces 22, 23 and the jaw portions 20, 21 are moved toward their closed position, the gripping surfaces 22, 23 apply generally opposing gripping forces to the workpiece.

Figure 2:
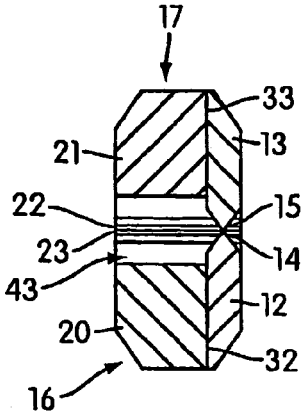
FIG. 2 shows a cross-section taken through the line 2—2 of FIG. 1.

Each blade member 12, 13 is rigidly secured to a respective jaw portion 20, 21 such that when the jaw portions 20, 21 are in their open position, the cutting edges 14, 15 are spaced apart from one another to enable a workpiece to be positioned between the cutting edges 14, 15 and such that when the jaw portions 20, 21 are in their closed position, the cutting edges 14, 15 are adjacent one another and are in abutting engagement with one another (see FIG. 2, for example). As the jaw portions 20, 21 move toward their closed position, the cutting edges 14, 15 cut the workpiece.

Methods of Making

FIGS. 1 and 2 show views of the illustrative pliers 10 in their assembled condition. FIGS. 3–4 and FIGS. 5–7 show the pliers 10 in various stages of completion during assembly to illustrate a way the pliers 10 may be assembled.

Each elongated member 16, 17 may be constructed of steel or of any other suitable metallic material. Each elongated member 16, 17 may be formed utilizing any appropriate metal forming and/or metal shaping method. For example, each elongated member 16, 17 may be constructed of a steel that is initially shaped by forging.

After forging, each elongated member 16, 17 may be further shaped to form features in the pliers 10. For example, after forging, each elongated member 16, 17 may be shaped by one or more machining operations to add features to or to further define features of the pliers 10. Machining may be carried out to further shape or to add detail to the handle portions 18, 19 of each elongated member 16, 17, for example, and/or to further shape or to add detail to the jaw portions 20, 21 of each elongated member 16, 17.

Each elongated member 16, 17 or portions of each elongated member 16, 17 may optionally be annealed after machining. After the elongated members 16, 17 are forged, shaped by machining and optionally annealed, the elongated members 16, 17 may then be movably connected or coupled to one another. In the illustrative embodiment, the elongated members 16, 17 are pivotally coupled 17 together by securing a rivet 28 through aligned openings 29 in the elongated members 16, 17. After the rivet 28 is installed, one or both ends of the rivet 28 may be ground or smoothed. One or both ends of the rivet 28 may, for example, be ground so that it is flush with the body 111 of the pliers 10.

After the elongated members 16, 17 are pivotally coupled to one another, a transversely extending slot is formed in the pliers body 11 to receive the blade members 12, 13. This may be carried out, for example, by placing the jaw portions 20, 21 in their closed position and machining a substantially continuous open-ended slot across the jaw portions 20, 21 of the tool body in a transverse direction. Alternatively, a slot can be formed in each jaw portion 20, 21 separately. This substantially continuous slot is comprised of a slot 30, 31 in each jaw portion 20, 21. The slots 30, 31 are spaced from one another because the illustrative jaws are shaped such that there is a central opening 43 disposed between the jaw portions 20, 21 when the jaw portions 20, 21 are in their closed position. The slots 30, 31 extend in a substantially transverse direction, are open-ended slots 30, 31 and extend from one side of a respective jaw portion 20, 21 to an opposite side thereof.

Figure 3:
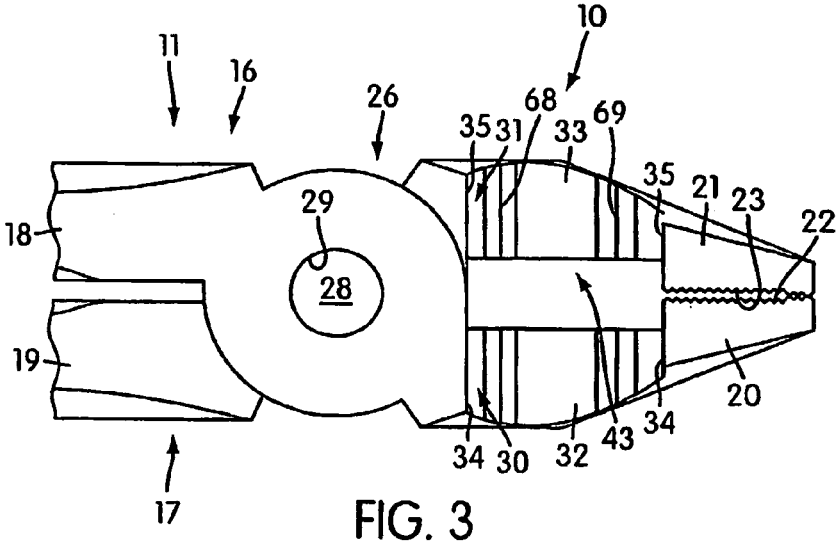
FIG. 3 is an enlarged view of a portion of the hand tool of FIG. 1 except showing the hand tool before a pair of blade members are mounted thereto.
Figure 4:
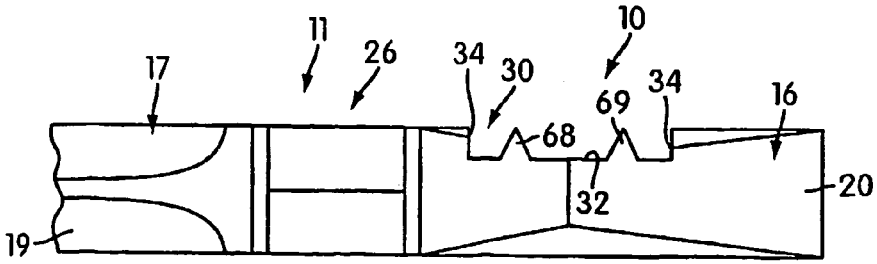
FIG. 4 is a side elevational view of the portion of the hand tool shown in FIG. 3.

The slots 30, 31 are sized and configured to receive the blade members 12, 13 (see FIGS. 3 and 4, for example). Each slot 30, 31 extends from one side of an associated jaw portion 20, 21 to an opposite side of an associated jaw portion and as mentioned, each slot has a pair of open opposite transverse ends. It can be appreciated that the slots 30, 31 are constructed and arranged such that when the jaw portions 20, 21 are in their closed position, the slots 30, 31 are transversely aligned with one another and cooperate with one another to form a substantially continuous slot that extends in a substantially transverse direction from one side of the tool body 11 to an opposite side of the tool body 11 (see, for example, FIGS. 1–4). The slots 30, 31 may be formed in the jaw portions 20, 21 as part of a single machining operation. Alternatively, the each jaw portion 20, 21 could be machined separately (e.g., before or after the elongated members are movably coupled to one another).

The slot 30 includes an outwardly facing wall surface 32 and a pair of longitudinally spaced side wall surfaces 34. The slot 31 includes an outwardly facing wall surface 33 and a pair of longitudinally spaced side wall surfaces 35. The slots 30, 31 may be machined such that when the jaw portions 20, 21 are in their closed position, the respective outwardly facing wall surfaces 32, 33 are aligned with one another (e.g., co-planar) and the side surfaces 34 on the elongated member 16 are aligned with (e.g., co-planar) adjacent side wall surfaces 35 on the elongated member 17, although this is not required. Each slot 30, 31 may be machined so that the respective side wall surfaces 34, 35 thereof are perpendicular to the associated outwardly facing wall surface 32, 33 (see FIG. 4, for example) although this is not required.

The body 11 of the pliers 10 is machined such that each slot 30, 31 includes one or more integral projecting portions 68, 69 that are used to form a projection weld between each blade member 12, 13 and a respective one of the slots 30, 31. Each jaw portion 20, 21 of the illustrative embodiment includes a plurality of projections 68, 69. In the illustrative embodiment, the projections 68, 69 are triangular, but the projections 68, 69 can have other constructions and cross-sectional shapes (e.g., square, rectangular, rounded, half-moon shaped or semi-circular, semi-oval) so the use of a triangular shape in the illustrative embodiment is not intended to limit the scope of the invention. There are two projections 68, 69 on each jaw portion 20, 21 and the projections 68, 69 are substantially equal in size to one another when viewed in cross-section (see FIG. 4, for example), but this is illustrative only and not intended to limit the scope of the invention. Other numbers of projections can be provided on each jaw portion 20, 21, the projections may be of unequal size to one another and may be of different constructions and cross-sectional shapes from one another in other embodiments of the invention. The integral projections 68, 69 may be machined so that they extend transversely from one open transverse side (or end) of a slot 30, 31 to the opposite open transverse side (or end) of the slot 30, 31. The example projections 68, 69 are parallel to one another, but this is not required.

Figure 8:
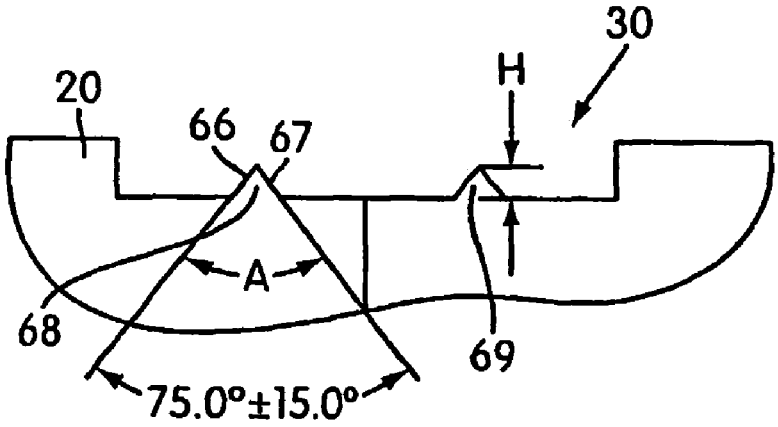
FIG. 8 is an enlarged side elevational view of a portion of a body of the hand tool of FIG. 4 showing a slot configured to receive a blade member.

The projections 68, 69 are utilized in a manner considered below during formation of the welded connections between the body 11 of the pliers 10 and the blade members 12, 13. The characteristics of the projections 68, 69 (e.g., shape, location, dimensions) of the illustrative embodiment are considered immediately below. The pair of illustrative projections 68, 69 are shown in enlarged side elevational view in FIG. 8. Each projection 68, 69 has a substantially triangular cross-section and a height H (see FIG. 8). The side surfaces 66, 67 of each projection 68, 69 form an angle A of each projection 68, 69. The angle A of each projection 68, 69 is preferably within the range of from approximately 60 degrees to approximately 90 degrees (i.e., the angle A may have a value of 75.0 degrees plus or minus 15.0 degrees). The pair of blade members 12, 13 are welded in the slots 30, 31 utilizing the projections 68 in a manner described below.

The slots 30, 31 and projections 68, 69 may be machined into the body 11 of the pliers 10 together as part of a single machining operation. After the slots 30, 31 and the projections 68, 69 are machined in the pliers 10 body 11, the pliers 10 may be heat treated to increase the hardness of the metallic material of the pliers body 11. Each elongated member 16, 17 may be constructed such that the metallic material of each elongated members 16, 17 is in a relatively soft state after the forging operation to enable the elongated members 16, 17 to be machined easily. Heat treating increases the hardness of the metallic material of the elongated members 16, 17 to make the metallic material of the pliers 10 body 11 hard enough to withstand the rigors of everyday use. The hardness of the metallic material may be increased, for example, from approximately 35 HRC to approximately 50 HRC. The amount the hardness is increased depends on several factors including, for example, the type of pliers being constructed and the types of jobs for which the pliers will be used. Generally, increasing the hardness of the metallic material of the pliers 10 body 11 increases the durability of the pliers 10.

During heat treatment, the metallic material of each elongated member 16, 17 may move and/or become distorted. This distortion/movement of the metallic material may occur during the heat treatment of the elongated members of pliers in particular because each elongated member 16, 17 may be relatively long and thin and may include intricately formed features. Therefore the pliers 10 may optionally be straightened after heat treatment to re-align and/or to reshape portions of the pliers 10. For example, the handle portions 18, 19 of the pliers 10 may be adjusted and/or the jaw portions 20, 21 may be adjusted. The tension of the pivot joint 26 provided by the rivet 28 may also be adjusted after heat treatment so that the pliers 10 pivot easily with respect to one another between open and closed positions.

The heat treatment may also cause the slots 30, 31 to move out of alignment with one another. For example, during heat treatment, the outwardly facing wall surfaces 32, 33 of the slots 30, 31 may move out of alignment with one another. It is generally not necessary to realign the slots 30, 31 (including the outwardly facing wall surfaces 32, 33) with one another after heat treatment to assure proper abutting alignment of the cutting edges 14, 15 of the blade members 12, 13 because the methods of projection or resistance welding the blade members 12, 13 to the body 11 of the pliers 10 described below assure proper alignment of the blade members 12, 13 with one another even if the wall surfaces 32, 33 are out of alignment with one another as a result of heat treatment of the pliers 10 body 11 or if the surfaces 32, 33 are out of alignment with one another for any other reason. Thus, misalignment of the outwardly facing wall surfaces 32, 33 generally will not result in the misalignment of the blade members 12, 13 when the blade members 12, 13 are secured within the slots 30, 31 using welding methods of the present invention.

Figure 5:
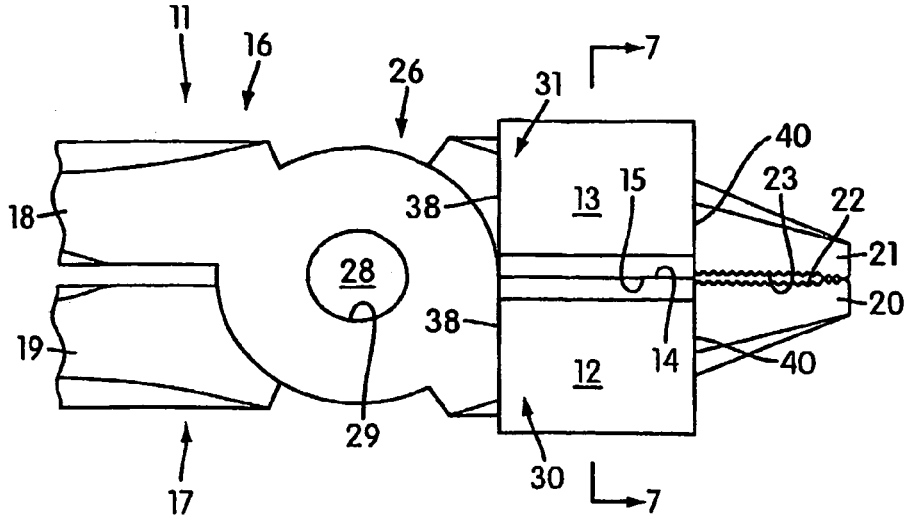
FIG. 5 is a view similar to FIG. 3 except showing a pair of blade members secured within slots formed in the hand tool.
Figure 6:
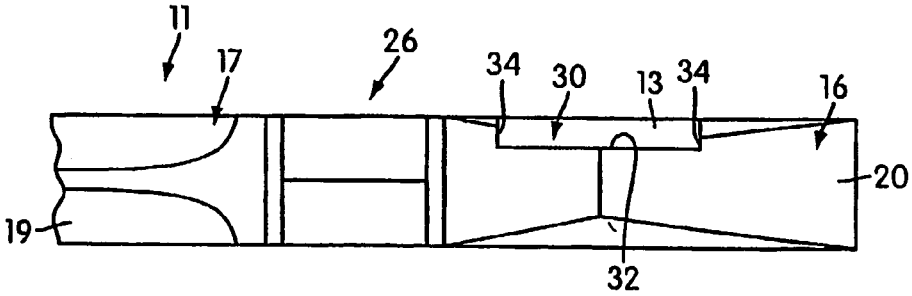
FIG. 6 is a side elevational view of the hand tool of FIG. 5.
Figure 7:
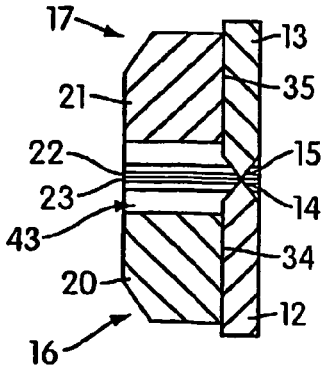
FIG. 7 is a cross-sectional view of the hand tool taken through the line 7—7 of FIG. 5.

After heat treatment of the body 11 of the pliers 10, the blade members 12, 13 may be secured within their respective slots 30, 31. The blade members 12, 13 may be secured within respective slots 30, 31 by projection or resistance welding or by a resistance brazing operation as described below. The blade members 12, 13 may initially be essentially rectangular (see FIGS. 5 and 7, for example). After each blade member 12, 13 is secured to a respective jaw portion 20, 21 of the pliers 10, portions of each blade member 12, 13 may be trimmed to provide each blade member 12, 13 with a shape that conforms to the shape of the body 11 of the pliers 10. FIGS. 5–7, for example, show the blade members 12, 13 in their untrimmed condition and FIGS. 1 and 2 show the blade members after trimming. In the illustrative embodiment of the pliers 10, outside edge portions of each blade member 12, 13 may be cut off and removed and optionally ground or polished to provide outside edges on each blade member 12, 13 that are shaped to conform to the outside edge of the jaw portions 20 of the pliers 10.

After the blade members 12 are installed and trimmed, the pliers 10 may be cleaned, degreased and/or polished. A rust preventative may be applied to the metallic material of the elongated members 16, 17 and/or the blade members 12, 13. Hand grips 44 may be installed on the handle portions 18, 19 of the elongated members 16, 17. The hand grips 44 may be constructed of a material (e.g., plastic material, a rubber material, a composite material) that provides a comfortable gripping surface for a worker's hand and/or that provides insulation (e.g., electrically insulating, thermally insulating) between the worker's hand and the metallic material of the elongated members 16, 17.

The metallic material used to construct the blade members 12, 13 (or at least the cutting edge portion of the blade members 12, 13) may be selected to have a relatively high degree of hardness (relative, for example, to the hardness of the metallic material used to construct the body 11 of the pliers 10). The blade members 12, 13 may be made of an appropriate alloy that is relatively hard to maximize the cutting performance and durability of the cutting edges 14, 15 of the blade members 12, 13. For example, the blade members 12 may be constructed of a high grade tool steel, a high carbon steel, or a highly alloyed steel. Other suitable metallic materials include martensitic or precipitation-hardenable stainless steel. The body 11 of the pliers 10 may be made of a lower grade of steel than is currently used in the manufacture of pliers that include cutting edges integrally formed in the material of the body.

Figure 28:
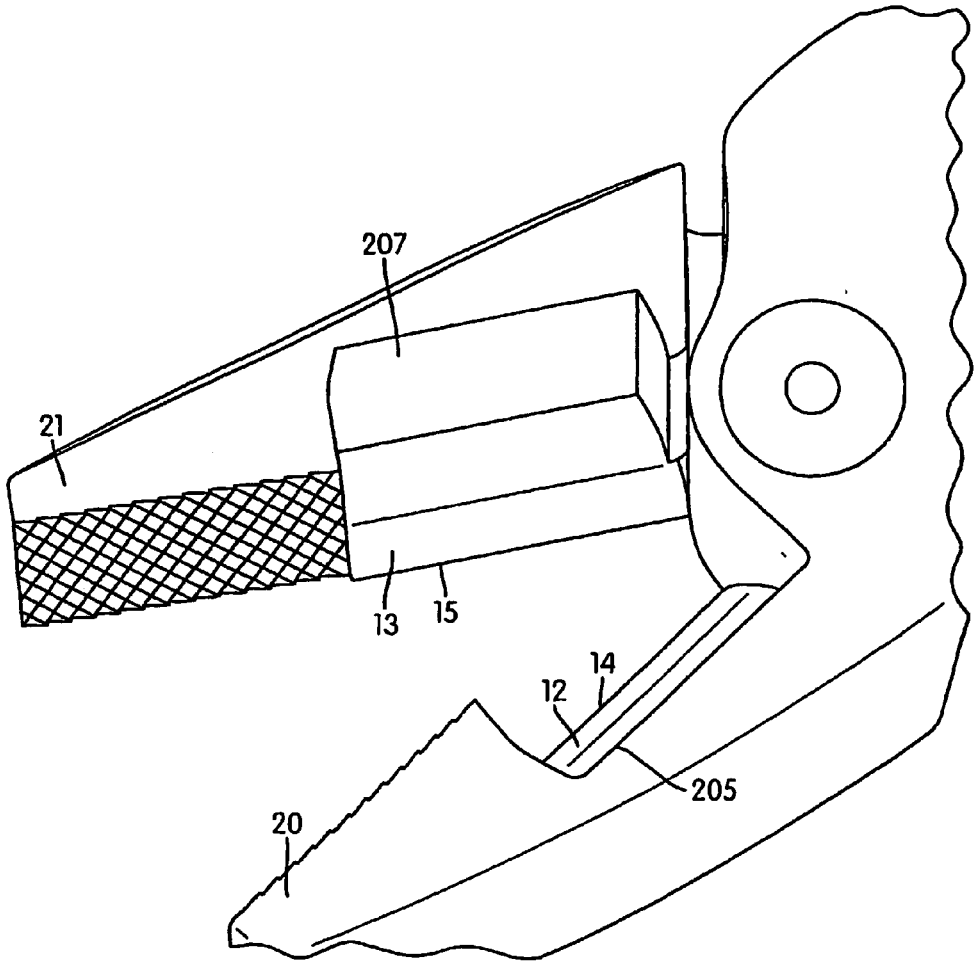
FIG. 28 is a perspective view of the hand tool shown in FIG. 1 illustrating a sloped surface provided in the area behind each cutting edge of the blade members.

As described above, the blade members 12, 13 are formed separately from the jaw portions 20, 21 and secured thereto by welding, for example. As a result, the cutting edges 14, 15 of the blade members 12, 13 do not need to be formed by machining, for example, which creates a pocket or recess behind each cutting edge. As discussed in the background section of the application, these pockets of recesses trap scrap material from the workpiece being cut which can adversely affect subsequent cutting operations. In contrast to known pliers, the area of the jaw portions 20, 21 behind each cutting edge 14, 15 of the blade members 12, 13 has a sloped surface 205, 207 that extends generally upwardly and outwardly from the respective blade member 12, 13, as viewed in FIG. 28. The sloped surfaces 205, 207 on the jaw portions 20, 21 are configured to guide scrap material away from the blade members 12, 13 such that the scrap material can easily fall away from the pliers.

Methods For Securing the Blade Members

Figure 9:
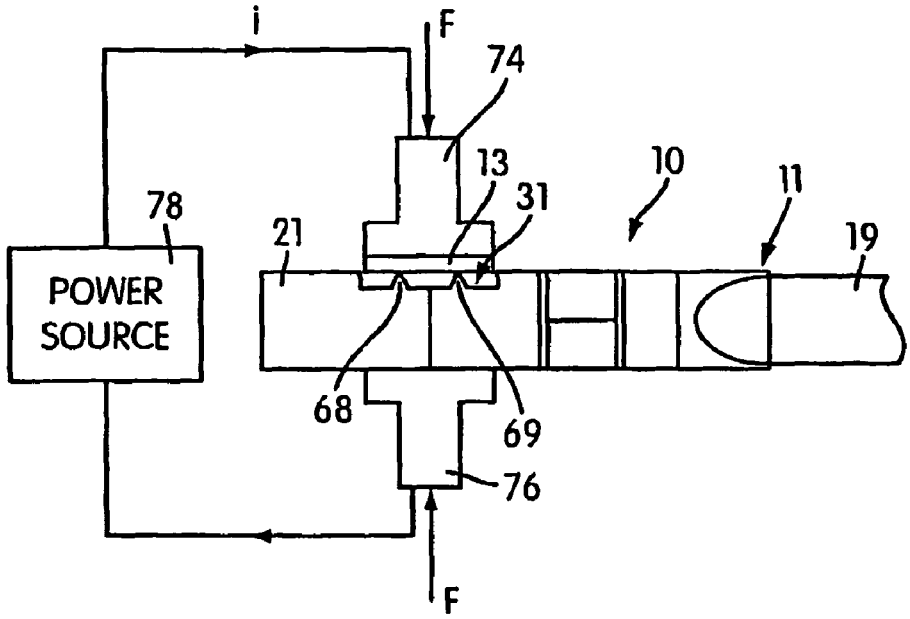
FIGS. 9 and 10 illustrate an example of a method for securing blade members to the hand tool of FIG. 1.
Figure 10:
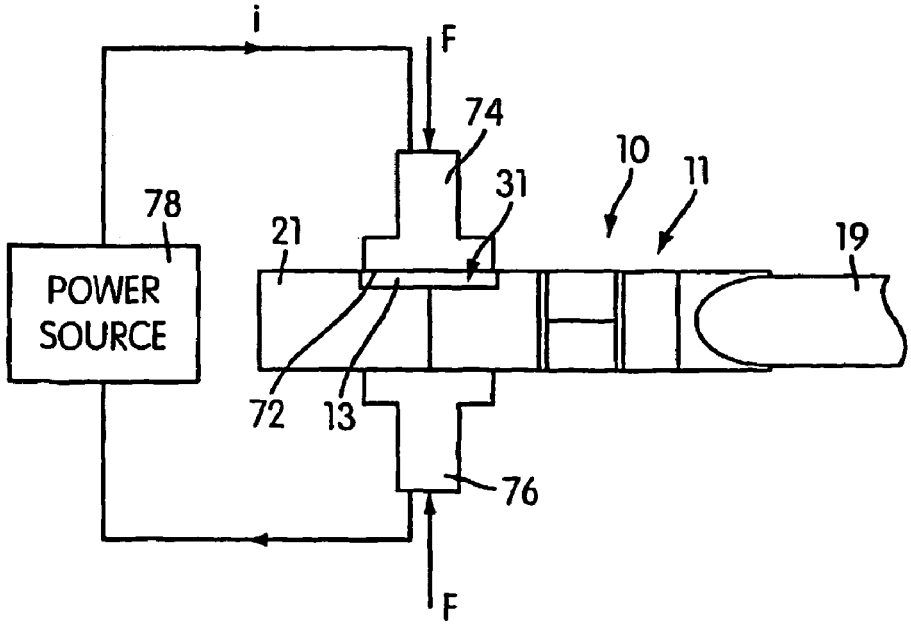

The blade members 12, 13 may be welded into the slots 30, 31 using a projection or resistance welding operation. An example of a resistance welding operation is illustrated in FIGS. 9 and 10. In this operation, each blade member 12, 13 is placed in contact with projections 68, 69 on respective jaw portion 20, 21 and an electrical current and force is applied to the tool body 111 and the blade members 12, 13. The applied electrical current (labeled i in FIGS. 9 and 10) flows through each projection 68, 69 on each jaw portion 20, 21 and through the associated blade member 12, 13. The applied electrical current establishes an electrical current of sufficient density flowing through each projection 68, 69 to heat each projection 68, 69 sufficiently to cause the metallic material of each projection 68, 69 to soften. The applied force (labeled F in FIGS. 9 and 10) moves each blade member 12, 13 and the softened metallic material from each projection 68, 69 toward the associated jaw portion 20, 21 thereby forming a welded connection between each blade member 12, 13 and a respective jaw portion 20, 21 of the tool body 11.

Each blade member 12, 13 is secured to the tool body 11 of the illustrative embodiment such that when the jaw portions 20, 21 are in their open position, the cutting edges of the blade members 12, 13 are spaced apart from one another and such that when the jaw portions 20, 21 are in their closed position, the cutting edges of the blade members 12, 13 are in abutting relation to one another. This construction is not required, however. As an alternative construction, the blade members may be secured to the tool body in some tool embodiments of the invention such that when the jaw portions are in their closed position, the cutting edges of the blade members are spaced from one another slightly (e.g., when constructing a wire stripper or, alternatively, a bypass cutter).

In one embodiment of the invention, each jaw portion 20, 21 includes a slot 30, 31, respectively, sized to receive a respective blade member 12, 13 and each projection 68, 69 on each jaw portion 20, 21 is disposed within the slot 30, 31 formed therein. The use of slots to secure the blade members 12, 13 to the body of the tool 10 is not required, however. In instances in which slots 30, 31 are included on the jaw portions 20, 21, a welding operation may be carried out by placing each blade member 12, 13 on a respective one of the jaw portions 20, 21 such that each blade member 12, 13 is in contact with each projection 68, 69 on a respective jaw portion 20, 21 and is aligned with a respective slot 30, 31. The applied force F moves each blade member 12, 13 and softened metallic material of each projection 68, 69 into the associated slot 30, 31 so that each blade member 12, 13 is disposed within a respective slot 30, 31 when the welded connection is formed between each blade member 12, 13 and the respective jaw portion 20, 21.

The blade members 12, 13 of the illustrative embodiment are mounted on the pliers 10 such that the cutting edges 14, 15 of the blade members 12, 13 extend radially with respect to the pivot axis, but this is not required by the invention. Other pliers constructions and other cutting tool constructions are included within the scope of the invention. For example, the blade members could be mounted on the jaw portions using methods according to some of the aspects of the present invention such that the cutting edges of the blade members are parallel to the pivot axis of the pliers.

According to one illustrative welding method, the blade members 12, 13 are placed in contact with the projections 68, 69 and aligned with the slots 30, 31. Two electrically conductive members or electrodes 74, 76 are placed generally on opposite sides of the body 11 of the pliers 10 (see FIG. 9). Each conductive member 74, 76 may be a copper electrode, for example. Each conductive member 74, 76 may be electrically connected to a respective terminal of a power source 78 which may be a current source, for example. The power source 78 may operate to provide a direct (DC) or alternating (AC) electrical current to the conductive members 74, 76 or both simultaneously or alternately. The source 78 can be controlled to produce an electrical current having the characteristics desired. For example, in instances in which the source 78 produces a direct current, the magnitude (amperage), duration and direction of the electrical current can each be independently controlled during a welding operation. In instances in which the source 78 produces an alternating electrical current, the characteristics of the current waveform including the magnitude, frequency, wave shape, and duration can each be independently controlled during a welding operation.

In the example illustrative method illustrated in FIGS. 9 and 10, one conductive member 74 is placed against outwardly facing side surfaces of both of the blade members 12, 13 and another conductive member 76 is placed against outwardly facing side surfaces of the jaw portions 58, 59 of the pliers 10 opposite the outwardly facing side surfaces of the blade members 12, 13. The body 11 of the pliers 10 and each blade member 12, 13 are constructed of electrically conductive materials.

One or both conductive members 74, 76 is operatively connected to a source of mechanical power (e.g., a hydraulic assembly or an air cylinder) and both conductive members 74, 76 cooperate to exert a controlled force (that is, a controllable force) on the blade members 12, 13 and on the tool body 11 in a direction which tends to move each blade member 12, 13 toward the body 11 of the pliers 10 and into a respective slot 30, 31 on the pliers 10. In the example illustrated in FIGS. 9 and 10, a force may be exerted on the blade members 12, 13 by the member 74 and the conductive member 76 may be rigidly secured in a fixed position so that the conductive member 76 provides a fixed support surface for supporting the pliers 10 during weld formation. The force applied to the pliers 10 during weld formation is labeled F and is indicated by directional arrows in FIGS. 9 and 10. In instances in which welded connections are formed between both blade members 12, 13 and the body 11 simultaneously, the jaw portions 20, 21 may be placed in their closed position and the blade members 12, 13 may be positioned prior to the commencement of the resistance welding operation such that the blade members 12, 13 are aligned with the slots 30, 31 and the cutting edges 14, 15 of the blade members 12, 13 are aligned with one another and are abutting one another, although this is not required.

Prior to the commencement of the current flow, the inwardly facing side surfaces of the blade members 12, 13 are in contact with the tips or apexes of the triangular projections 68, 69 (see FIG. 9, for example). After the electrical current is commenced, the electrical current flowing through the blade members 12, 13 and the body of the pliers 10 passes through each triangular projection 68, 69. The density of the current flowing through each projection 68, 69 is high relative to the current density flowing through the blade members 12, 13 or through other portions of the body 11 of the pliers 10. The projections 68, 69 therefore function, in effect, as energy directors which tend to concentrate the current flowing between the body 11 of the pliers 10 and the blade members 12, 13 and thereby increase the current density in the projections 68, 69.

A current of sufficient magnitude is established in each projection 68, 69 to cause each projections 68, 69 to heat each projection to a temperature at which the yield strength of the metallic material comprising the projections 68, 69 is lowered sufficiently to cause the metallic material of the projections 68, 69 to soften or, alternatively, to flow. As the current is being applied, the conductive members 74, 76 exert force F (which force may be constant or variable in various embodiments of the invention) on the blade members 12, 13 and on the body 11 of the pliers 10. The clamping force F causes the metallic material of the projections 68, 69 to collapse or deform and to spread out between the inwardly facing side surface of the blade members 12, 13 and the respective outwardly facing wall surface 32, 33 of the slots 30, 31. The conductive member 74 is constructed and positioned to apply a force F to both blade members 12, 13 simultaneously during a welding operation. Because the conductive member 74 is in contact with both blade members 12, 13, the blade members 12, 13 move in dimensional unison toward the bottom wall surfaces 32, 33 of the respective slots 30, 31. Therefore, the cutting edges of the blade members maintain alignment with one another as the blade members are moved toward the body of the tool. The high current density in the projections 68, 69 and the clamping forces cooperate to create a solid state resistance weld between the blade members 12, 13 and the metallic material of the jaw portions 58, 59. Although a solid state weld is preferred, the blade members 12, 13 and jaw portions 58, 59 may be coupled to one another in any other suitable manner.

FIG. 10 shows the blade members 12, 13 in the slots 30, 31 of the pliers 10 after the welding operation and the optional low current tempering operation are completed. A quench and temper follows the weld.

After weld formation between the blade members 12, 13 and the jaw portions 20, 21 of the tool body 11, the welded area may be brittle. This brittleness may be undesirable for some hand tools. The brittleness of the welded area may be substantially reduced or eliminated by tempering each weld area. For example, the brittleness of the weld area may be reduced or eliminated by passing a lower current (lower relative to the magnitude of the electrical current used during weld formation) for a predetermined amount of time through the conductive member 74, 76 and through the welded area of the pliers 10. This relatively low current tempers the welded area to a desired level of hardness. For example, the hardness of the welded area can be reduced by applying a relatively low current to the welded area to give each welded area a hardness of approximately 45 HRC.

As mentioned, after weld formation, edge portions of each blade members 12, 13 may be cut or trimmed off and removed to conform the outside edges of the blade members 12, 13 to the shape of a body of the pliers 10.

Figure 11:
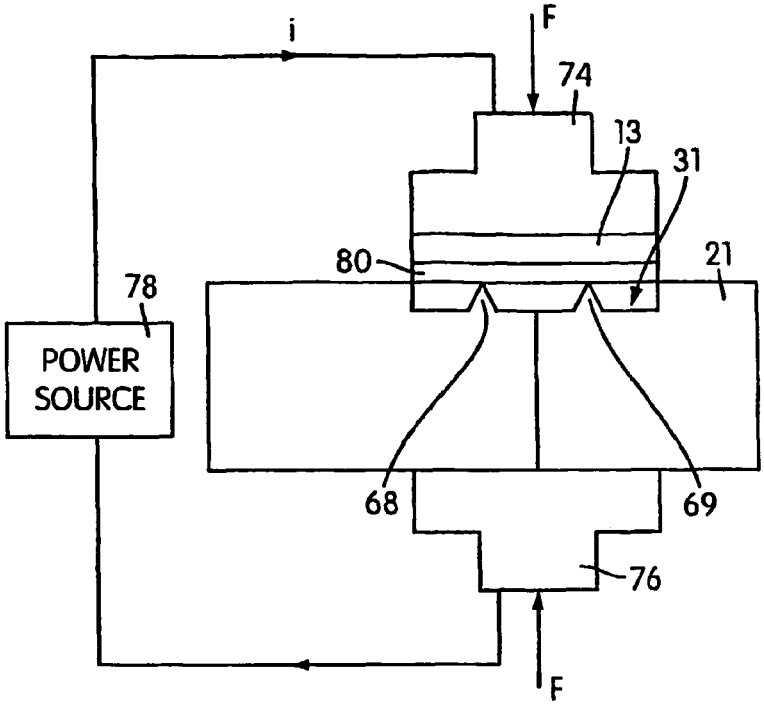
FIGS. 11 and 12 illustrate an example of another method for securing the blade members to the hand tool of FIG. 1.
Figure 12:
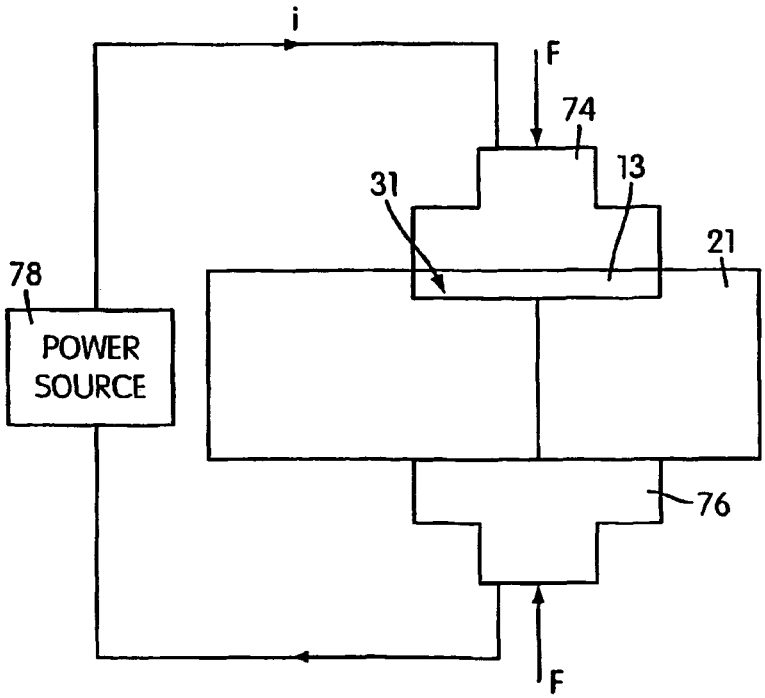

FIGS. 11 and 12 show another example of a welding operation that can be used to secure the blade members 12, 13 to the pliers 10. It can be appreciated that only slot 31 and blade member 13 are visible in FIGS. 11 and 12, but the discussion applies equally to slot 30 and the associated blade member 12. In this example, a thin piece of metallic material or foil 80 is placed between the projections 68, 69 of slot 31 and the blade member 13. Another piece of thin sheet of metal or foil (not shown) is placed between the projections 68, 69 of the slot 30 and the blade member 12. The foil pieces 80 can be used to carry out a resistance braze-type of welding operation. While the illustrative welding operation is described with reference to blade member 13, foil piece 18, and slot 31 only, it can be understood that an identical welding operation may occur simultaneously to secure blade member 12 within slot 30.

The foil piece 80 may be constructed of a variety of different metallic materials and may have a variety of different properties. For instance, in one example of a resistance braze welding operation, the foil piece 80 has a lower melting point than the melting point of the metallic material used to construct the blade member 12 and the foil piece 80 has a lower melting point than the melting point of the metallic material used to construct the body of the pliers 10 (including the projections 68, 69 integrally formed on the body of the pliers 10). The foil piece 80 may also have a higher bulk resistance (i.e., a higher resistance to the passage of electrical current) than either the material used to construct the blade member 13 or the material used to construct the body 11 of the pliers 10. The metallic material used to construct the foil piece 80 is also preferably metallurgically compatible with the metallic material used to construct the blade member 13 and with the metallic material used to construct the body 11 of the pliers 10.

Examples of suitable materials used to construct the foil piece 80 include stainless steel, copper, or Inconel™. Any of these materials may be used to construct the foil piece 80 in instances in which the body 11 of the pliers 10 and the blade members 12, 13 are each constructed of appropriate respective grades of steel, for example. Each piece of foil 80 may have approximately the same length and width dimensions as the associated slot and each piece of foil 80 may have a thickness (i.e., the vertical dimension in FIGS. 14 and 15) of between approximately 0.001 inch and 0.020 inch. The relative thickness of the foil 80 is exaggerated (that is, the thickness is disproportionately large) in FIG. 11 to better illustrate the invention.

To secure the blade member 13 within the slot 31, the power source 78 is energized which causes an electrical current i to flow between the conductive members 74, 76. This electrical current flows through the blade member 13, through the foil 80 and through the body 11 of the pliers 10. A force F is applied by the conductive members 74, 76 to the blade members 12, 13 and to the body 11 of the pliers 10. The force F tends to move the blade members 12, 13 simultaneously toward and into the respective slots 30, 31. In the example illustrated in FIGS. 11 and 12, a force F is applied by both conductive members 74, 76, but in other instances a force F can be applied by only one conductive member 74, 76 and the other conductive member can be fixed and function to support the pliers 10 under pressure from the other member. Alternatively, in each of the methods described herein, although it is preferable to apply the force or forces F and the current with the same structures, this is not required. That is, one or more structures can be used to apply current and another structure or set of structures can be used to apply the force or forces. The force F may be applied simultaneously with the application of current through the blade members 12, 13, the foil 80, and the body 11 of the pliers 10.

Each welded connection is made by applying an electrical current and a force to the pliers. The applied electrical current flows through each projection 68, 69 and through each sheet of metallic material or foil 80 and through the associated blade members 12, 13. The electrical current in the projections 68, 69 and in the foil 80 has a density sufficient to cause the metallic material of each projection 68, 69 to soften or, alternatively, to flow locally, and to cause the metallic material of each sheet of metallic material 80 to soften or flow locally. Force F moves each blade member 12, 13 and softened metallic material from each projection 68, 69 and the softened or flowing metallic material from each sheet of metallic material 80 into the associated slot 30, 31 and thereby forms a welded connection between each blade member 12, 13 and the associated slot 30, 31.

In instances in which a single conductive member 74 is in contact with both blade members 12, 13, the force F is applied to both blade members 12, 13 simultaneously. The conductive member 74 therefore moves both blade members 12, 13 into their respective slots 30, 31 simultaneously and in dimensional unison. Thus, the single conductive member 74 is operable to keep the cutting edges of the blade members 12, 13 aligned with one another as the blade members 12, 13 move into their respective slots 30, 31. The metallic material from the projection 68, 69 (and from the foil 80 in instances in which the foil 80 is included in the welding operation) spreads out between the blade members 12, 13 and the wall surfaces 32, 33 of the slots 30, 31. This spreading out of the metallic material during formation of the welded connections and the use of a single conductive member 74 to move the blade members 12, 13 in an aligned arrangement (that is, with the cutting edges aligned with one another) assured that the cutting edges 14, 15 of the blade members 12, 13 are aligned with one another after the welded connections are formed, even if the outwardly facing wall surfaces 32, 33 are out of alignment with one another prior to weld formation.

After the blade members 12, 13 are moved into the slots 30, 31, the projections have substantially disappeared and the blade members 12, 13 are essentially flush with the bottom wall surfaces 32, 33 of the slots 30, 31 (see FIG. 12). A quenching operation and/or a tempering operation may optionally be carried out after formation of the weld.

The welding methods of the present invention create a welded connection between the blade members 12, 13 and the body 11 of the pliers 10 rapidly enough that the cutting edge portion of each blade member 12, 13 is not heated sufficiently to affect the hardness or the quality of the blade members 12, 13 in the regions providing the cutting edges 14, 15. Thus, when a resistance welding operation is completed, the cutting edges 14, 15 of the blade members 12, 13 have their original hardness (that is, their pre-weld hardness). Thus, the hardness of the cutting edge portions of the blade members 12, 13 is essentially the same before and after the resistance weld operation.

In a particular example, the cutting edges 14, 15 of each blade members 12, 13 may have a hardness of approximately 60 HRC both before a welding operation is commenced and after the welding operation (including the optional quenching and/or tempering operations) is completed. Thus, the resistance welding operation of this example affects only localized areas or portions of each blade members 12, 13 distant from the edge portions of the blade members 12, 13 that form the cutting edges 14, 15 and therefore has no appreciable effect on the hardness of cutting edges 14, 15 of the blade members 12, 13.

The welding operations described above, including the welding operations illustrated in FIGS. 9–10 and FIGS. 11–12 may be carried out in a variety of ways. For example, the weld parameters and physical characteristics of the conductive members 74, 76 and of any of the various components of the pliers 10 (e.g., the blade members 12, 13, the body of the pliers 10, and/or the foil 80) may assume a wide range of values. A variety of materials may be used to construct the conductive members 74, 76, the blade members 12, 13, the body of the pliers 10, and/or the foil 80. Each of these structures may have a variety of constructions.

For instance, the conductive members 74, 76 used in either of the welding operations illustrated in FIGS. 9–10 or in FIGS. 11–12 may have a hardness within the range of from approximately 70 Rockwell Hardness B (HRB) to approximately 45 HRC. Each conductive member 74, 76 may have an electrical conductivity of between approximately 40% International Annealed Copper Standard (IACS) and approximately 90% IACS. This level of electrical conductivity for the conductive members 74, 76 may be achieved by constructing each conductive member 74, 76 from a Class 2, Class 3, or Class 20 copper.

The welding operations described in FIGS. 9–10 and FIGS. 11–12 may be carried out using an alternating or direct current. For example, the power source 78 may be operated to provide a current to the conductive members 74, 76 having a frequency of 60 cycles per second (cps). In this instance, each welding operation may be performed during approximately one current cycle up to approximately four current cycles (i.e., in at time period of from approximately 0.008 seconds up to approximately 0.100 seconds). During each welding operation, a peak electrical current of approximately 70 kilo amps (KA) to 200 KA or approximately 50 KA RMS (root mean squared) to 150 KA RMS may be applied through each conductive member 74, 76.

A quenching operation and/or a tempering operation may optionally be carried out after either of the illustrative welding operations of FIGS. 9–10 or of FIGS. 11–12 is performed. For example, after the blade members 12, 13 are welded within the slots 30, 31, the welded connections may be quenched for between 1 and 15 seconds. After quenching, the welded connection may be tempered for a period of time between approximately 1 and approximately 5 seconds and may be tempered for more than five seconds. The electrical current used for tempering each welded connection may be approximately 10 to 20 kiloamps per linear inch of projection at height H (see FIG. 8, for example) of each projection 68, 69.

The characteristics of the projections (e.g., the size and shape of each projection, the number of projections, the spacing of the projections relative to one another) may be varied. In the instance in which each projection 68, 69 has a triangular cross-section, each projection 68, 69 may have a wide range of angular configurations. For example, as mentioned, the illustrative projections 68, 69 may have an included angle of between approximately 60 degrees to approximately 90 degrees (see, for example, FIG. 8). The characteristics of the projection 68, 69 may be varied according to the requirements of the particular welded connection being formed. For example, in the instance in which each projection has a triangular cross-section, the height of each projection and/or the included angle of each projection may vary depending upon the requirements of each weld.

For example, projections having a greater height H may be used when a stronger welded connection between each blade member and the body of the hand tool is desired. The heights of the projections may also be reduced in instances in which a sheet of material (such as foil piece 80) is placed between each blade member and the body of the hand tool. The clamping force F applied to the blade members and to the body of the hand tool may also vary. For example, a clamping force F of approximately 3500 pounds to approximately 5000 pounds of force per linear inch of projection at height H may be applied during a welding operation in which the blade members 12, 13 are welded to the pliers 10.

A wide range of blade types and blade constructions may be used for one or both blade members. Blade members may be constructed having a wide range of cutting edge profiles or geometries. FIGS. 13–21 illustrate various examples of cutting edge profiles. Each cutting edge profile may be designed to provide maximum durability of the cutting edge and to reduce or minimize the effort required for cutting during particular cutting operations.

Figure 13:
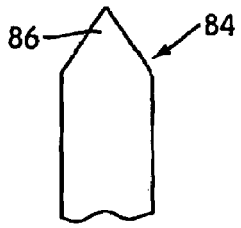
FIGS. 13–16 show illustrative embodiments of some of the profiles the cutting edges of blade members may have.

FIG. 13 shows an illustrative embodiment of a blade member 84 having a cutting edge 86 that has a two-sided regular bevel profile. A blade member could also be constructed having a one-sided regular bevel for mounting on a pair of pliers or other hand tool.

Figure 14:
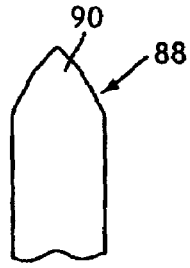

FIG. 14 shows an illustrative embodiment of a blade member 88 having a cutting edge 90 that has a two-sided compound bevel profile. A blade member could also be constructed having a one-sided compound bevel for mounting on a pair of pliers or other hand tool.

Figure 15:
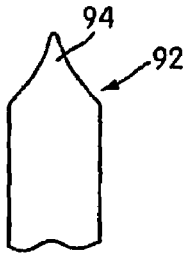

FIG. 15 shows an illustrative embodiment of a blade member 92 having a cutting edge 94 that has a two-sided hollow bevel profile. A blade member could also be constructed having a one-sided hollow bevel.

Figure 16:
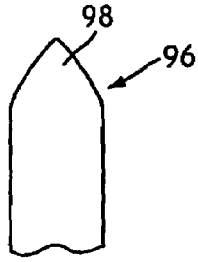
Figure 17:
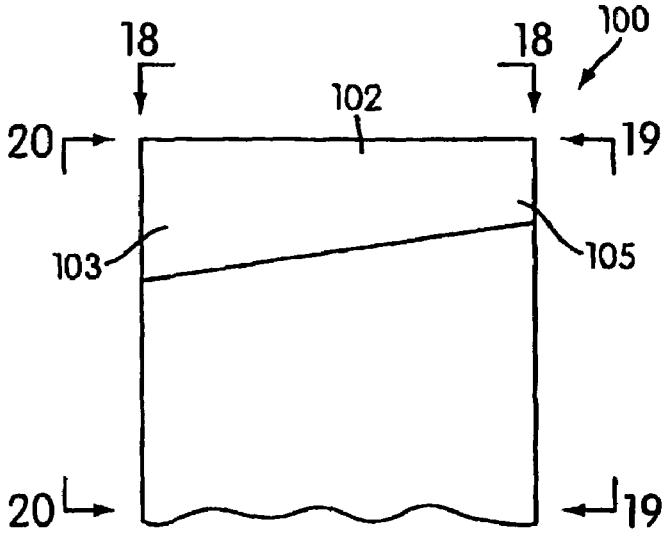
FIG. 17 is another illustrative embodiment of a blade member.
Figure 18:
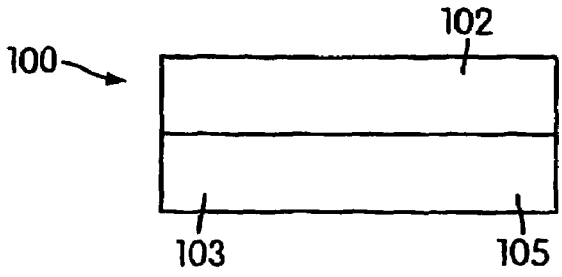
FIG. 18 is a view of the blade member of FIG. 17 taken along the line of sight 18—18 of FIG. 17.
Figure 19:
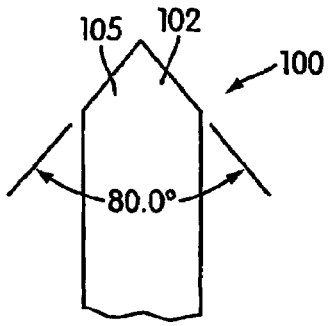
FIG. 19 is a view of the blade member of FIG. 17 taken along the line of sight 19—19 of FIG. 17.
Figure 20:
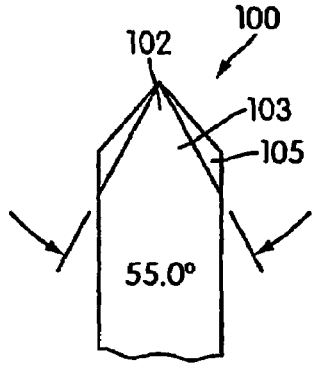
FIG. 20 is a view of the blade member of FIG. 17 taken along the line of sight 20—20 of FIG. 17.

FIG. 16 shows an illustrative embodiment of a blade member 96 having a cutting edge 98 that has a two-sided parabolic bevel profile. A blade member could also be constructed having a one-sided parabolic bevel.

FIGS. 17-20 show an illustrative embodiment of a blade member 100 having a variable angle cutting edge 102. The cutting edge 102 of the blade member 100 has a two-sided bevel. The cutting edge angle of the bevel varies from one end 103 of the blade member 100 to an opposite end 104 of the cutting edge. The cutting edge angle may vary continuously from one end 103 to the opposite end 104. The illustrative cutting edge varies from an angle of approximately 55 degrees at one end 103 to an angle of approximately 80 degrees at an opposite end. A blade member having a variable cutting edge may be designed to provide cutting edge durability at the less sharp end and to provide greater ease of cutting at the opposite sharper end. This may allow, for example, a user to cut very hard materials using the less sharp edge section of the blade member without damaging the cutting edge. The opposite sharper end could be used, for example, to cut softer and/or finer (i.e., smaller diameter) materials.

Figure 24:
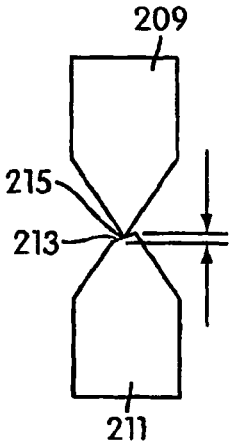
FIG. 24 is a side view of an embodiment of blade members wherein one of the blade members is in the form of a knife blade and the other of the blade members is in the form of an anvil having a ramped surface, the knife blade being offset from the ramped surface of the anvil.
Figure 25:
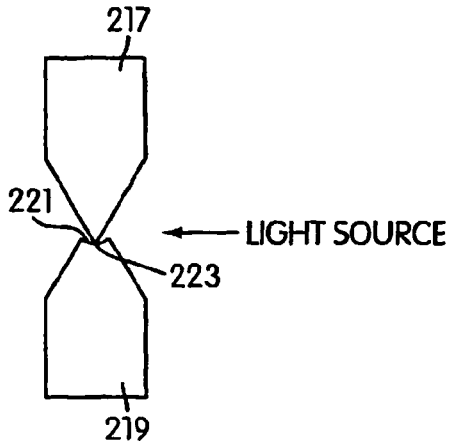
FIG. 25 is a side view of an embodiment of blade members wherein one of the blade members is in the form of a knife blade and the other of the blade members is in the form of an anvil having a concave arcuate surface.
Figure 26:
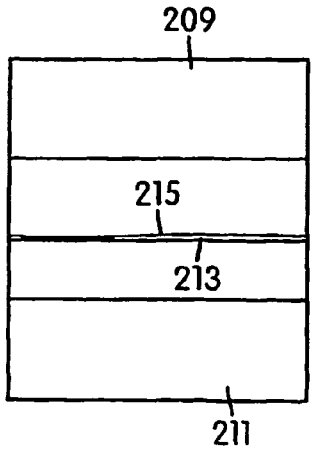
FIG. 26 is a front view of the blade members shown in FIG. 24.
Figure 27:
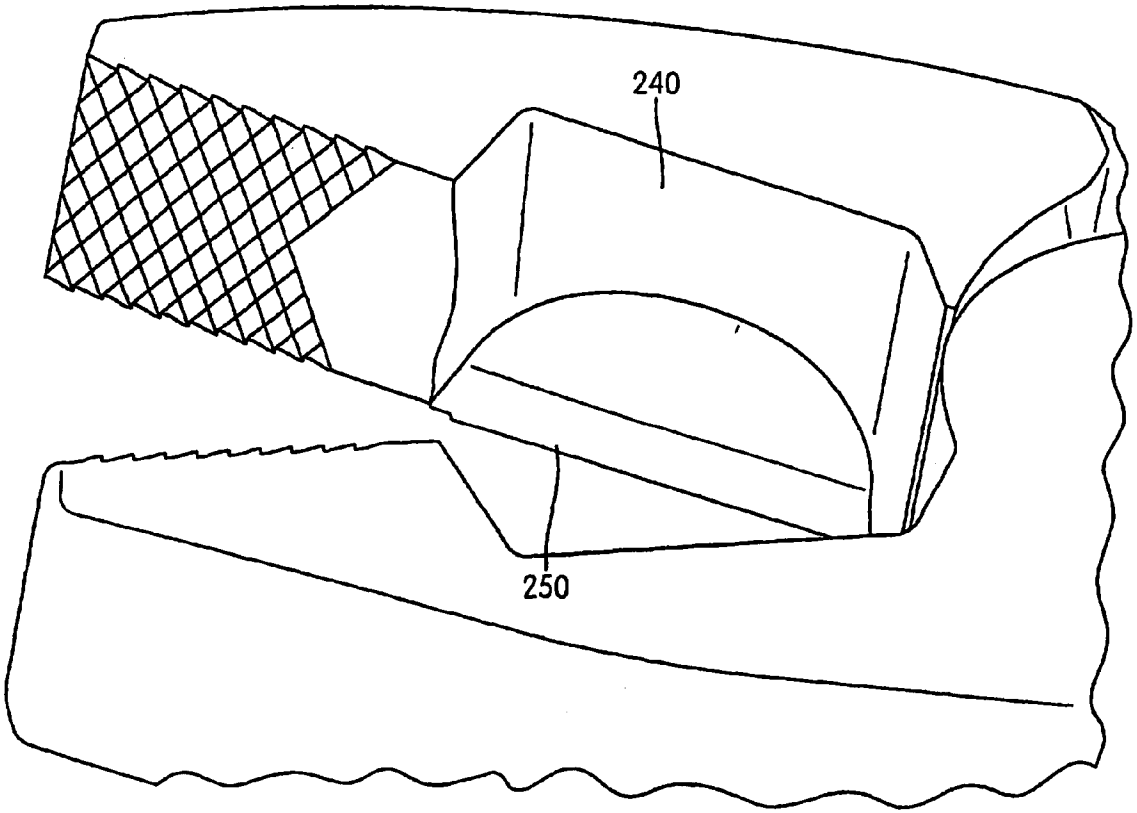
FIG. 27 is a perspective view of a known pliers half having a recess or pocket on the back side of the cutting edge.

FIGS. 24–26 illustrate two embodiments of blade members structured to accurately align the cutting edges and prevent light from passing through cutting edges thereof when the pliers are closed together. As shown in FIG. 24, one of the blade members is in the form of a knife blade 209 and the other of the blade members is in the form of an anvil 211 having a ramped surface 213. The knife blade 209 is offset from the ramped surface 213 of the anvil 211 such that when the jaw portions are in their closed position, the cutting edge 215 of the knife blade 209 is relatively close to the ramped surface 213 of the anvil 211 and light cannot pass therethrough (as shown in FIG. 26) because the cutting edge 215 of the knife blade 209 is masked by the ramped surface 213 of the anvil 211. This indicates to the consumer that the pliers have good quality cutting edges.

FIG. 25 illustrates another embodiment of blade members to prevent light passing therethrough when the pliers are closed together. In this embodiment, one of the blade members is in the form of a knife blade 217 and the other of the blade members is in the form of an anvil 219 having a concave arcuate surface 221. When the jaw portions are in their closed position, the cutting edge 223 of the knife blade 217 is relatively close to the concave arcuate surface 221 of the anvil 219 such that light cannot pass therethrough because the cutting edge 223 of the knife blade 217 is masked by the concave arcuate surface 221 of the anvil 219. The prevention of light from passing through the knife blade 217 and anvil 219 indicates pliers with good quality cutting edges.

The embodiments of blade members described above do not adversely affect cutting performance. Moreover, the embodiments of blade members deals with even the slightest mismatch of cutting edge alignment, e.g., created by the welding process.

Each blade may be engineered for optimal performance in one or more types of cutting operations. Generally, the blade members may be constructed of higher quality and higher cost metallic material than is used to construct the tool body. By making the blade members as separate structures from the tool body, much higher cost and higher quality materials can be used to construct the blade members while still allowing the body portion of a hand tool to be constructed of a metallic material that is less expensive material and/or that is easier to form. The cutting edge geometry for a pair of pliers or other type of cutting tool can be optimized to provide an optimal blade for particular uses. Making the blade members separately and then securing the blade members to the body of a hand tool also enables a manufacturer to make pliers and other hand tools that have cutting edges of uniform and consistent quality. Making the blade members separately also enables a manufacturer to make the blade members in a controlled environment using automated equipment. A plurality of blade members could also be manufactured as a continuous strip and then cut into individual blade members.

Although it may be desirable to construct each blade member of a hard metallic material, some hard metallic materials may be difficult to join to a tool body and may require special procedures. For example, carbon may be used as an alloying element in metallic materials such as steel to increase the metal hardness and wear resistance. Generally, steels having a carbon content of over 0.55% may be difficult to join to a body portion of a hand tool (e.g., pliers) by welding. It may, for instance, be difficult to secure a blade member having a relatively high carbon content to a body portion of a hand tool using a resistance weld. It may be desirable in some instances and for some applications to use a steel having a carbon content of 1.0% or more to make the cutting edge of each blade member.

Figure 21:
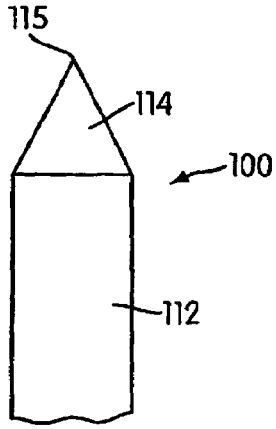
FIG. 21 is an illustrative embodiment of a bi-material blade member.
Figure 22:
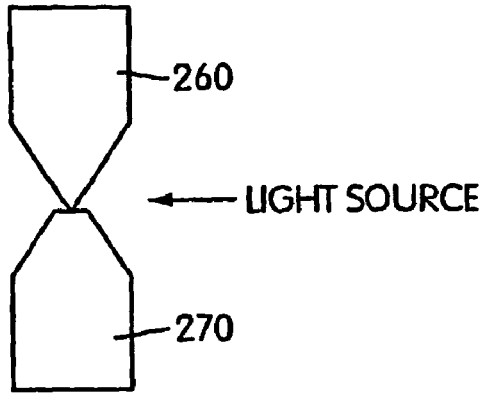
FIG. 22 is a side view of known pliers in which a single cutting blade works cooperatively with an anvil on an opposing jaw, the cutting edges of the blade and anvil being not perfectly straight due to typical manufacturing deviations which allows light to pass between the edge of the blade and the anvil during a light test.
Figure 23:
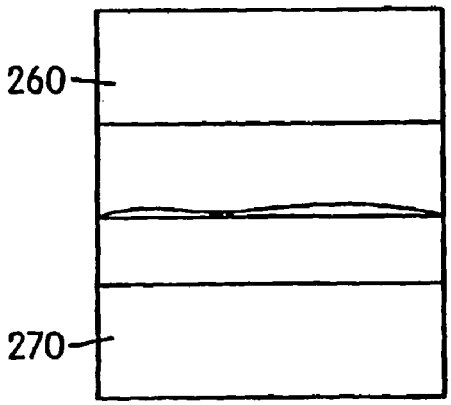
FIG. 23 is a front view of the known pliers shown in FIG. 22.

It is contemplated to construct a blade member of two or more metallic materials. FIG. 21 shows an illustrative embodiment of a blade member 110 constructed of two metallic materials. The blade member 110 includes a backing portion 112 that is constructed of a first metallic material and includes a cutting edge portion 114 that is constructed of a second metallic material. The backing portion 112 may be constructed of a metallic material that can be easily welded to the body of a hand tool and the cutting edge portion 114 may be constructed of a metallic material that is relatively hard (e.g., a high carbon steel) and forms a durable cutting edge 115.

The blade member 110 may be constructed from a sheet of a bi-material metal such as a bi-material steel. Bi-material steels are readily commercially available and may be comprised of a thin strip of an AISI (American Iron and Steel Institute) tool steel (e.g., a high speed steel (HSS)) that is electron beam welded to a backing material which may be constructed of a less expensive metallic material. The high speed steel portion of a sheet of a bi-material steel could be used to form a cutting edge portion 114 of a blade member 110 and the backing material section of a sheet of a bi-material steel could be used to form the backing portion 112 of the blade member 110.

The high-speed steel portion of a bi-material steel may contain a relatively large amount of carbon and the backing material portion may contain relatively less carbon. The backing portion 112 of the blade member 110 may contain a relatively low amount of carbon so that the backing portion 1112 of the blade member 110 can be easily welded to the body portion of a hand tool such as a pair of pliers. The backing portion 112 of the blade member 110 can be securely welded to the body of the hand tool and the cutting edge portion 114 provides a durable cutting edge 115.

Blade members for mounting in a hand tool such as a pair of pliers could also be constructed from bi-material metals that include a backing portion and a strip of metallic material having a machine tool coating such as, for example, titanium nitrite (TiN). The strip of metallic material provides the cutting edge portion of the blade member. A blade member in some illustrative embodiments of the invention could thus have a cutting edge portion and a backing portion. The cutting edge portion of a blade member could be constructed of a relatively hard metallic material (a high carbon steel, for example) that has a machine tool coating. The backing portion of the blade member could be constructed of a metallic material that is relatively easy to weld (relative to the material used to form the cutting edge portion) such as a relatively low carbon steel, for example. It may be desirable to provide a coating on a cutting edge portion of the blade member that would increase the hardness of the cutting edge and/or increase the lubricity of the cutting edge. A coating, for example, could reduce the cutting force exerted by a worker during the cutting of a workpiece by increasing the lubricity between the cutting edge and the workpiece.

It can be appreciated that the illustrative embodiments of the hand tool are intended to teach the principles of the invention and to illustrate particular examples of the invention, and are not intended to limit the scope of the invention. Many variations of the invention are contemplated. It is contemplated to construct may types of machines and tools, including may types of hand tools, according to the principles of the present invention.

The principles of the invention can be applied to a broad range of types of pliers and pliers-type tools, for example, and is not limited to the example embodiments shown and described. For example, although elongated members of the pliers are illustrated as being movably coupled to one another utilizing a simple pivot-type connection, this is not intended to be limiting. Any type of coupling could be used to movably couple the elongated members to one another. Similarly, although the elongated members of the pliers are illustrated as being movably coupled to one another at intermediate portions, thereof, this is illustrative only and not intended to limit the scope of the invention. One skilled in the art will appreciate that a pair of elongated members could be movably coupled to one another in many different way to improve leverage, for example, or to construct tools for various applications, and that the elongated members need not be movably coupled to one another at intermediate positions thereof.

One skilled in the art will also appreciate that although the pliers illustrated herein include gripping surfaces, this is not required by the invention. It can also be appreciated that although the gripping surfaces are illustrated as being positioned at the end of the jaw portions, this is not intended to limit the scope of the invention and the gripping surfaces can be located in a wide range of locations on a particular hand tool. One skilled in the art will also appreciate that although the pliers are illustrated as having a pair of cooperating blade members that abut one another in the closed position, this in not required and many other embodiments and arrangements are contemplated. For example, a pair of pliers-type cutters could be constructed which include a single cutting blade that works cooperatively with an anvil on an opposing jaw (e.g., a pair of pruning-type cutters for cutting stems and other vegetation). As another example, a pair of blade members according to the invention could be mounted according to the invention on a cutting tool to provide a shearing type action (e.g., a pair of scissors or a pair of hedge clippers).

One skilled in the art will also appreciate that the order of the various operations that occur when constructing a pliers-type tool can vary widely and that the examples illustrated herein are not intended to limit the scope of the invention. Thus, the various operations the occur when constructing a hand tool such as a pair of pliers can carried out in a many different orders. For example, slots (which are themselves optional and not needed to secure the blades using a projection welding operation) can be formed in the elongated members before they are movably coupled to one another or after they are movably coupled to one another. Similarly, the blade members can be secured to the elongated members before the elongated members are movably coupled to one another or after. The particular order in which the various features are formed and/or the particular order in which components of a hand tool are assembled to one another can vary widely depending on a number of factors including, for example, the type of tool being constructed and the use to which the tool will be put. The blade members can be secured to the tool body simultaneously or, alternatively, one blade member can be secured to the tool body and then the other blade member can be secured to the tool body after the first blade member is secured thereto. The blade members can be secure to the body of the pliers when the pliers are in their closed position, their open position or in their partially open position. The manner in which a particular pair of pliers is assembled will depend on a number of factors, including, for example, the type of pliers being produced and the types of jobs the pliers will be used for and so on.

The principles of the invention can be applied to hand tools other than pliers. For example, the principles of the invention can be used to construct a pair of dedicated wire cutters that do not include gripping surfaces. The principles of the present invention can also be applied to the construction of tools that have a shears-type construction such as hedge clippers or scissors or can be applied to the construction of tools that include only one cutting edge such as chisels. The invention can also be used to construct a tool that does not include a cutting edge. For example, a tool according to the invention can be constructed that includes one or more workpiece engaging structure constructed at least in part of a relatively harder material, each workpiece engaging structure being attached to a tool body constructed of a relatively softer metallic material, and the relatively harder portion of each workpiece engaging structure providing a workpiece engaging portion or surface (e.g., to grip, shape, crimp a workpiece). Each structure can be secured to the tool body by welding according to the principles of the present invention without substantially changing the physical properties of the relatively hard portions of each structure that is secured to the tool body.

While the invention has been disclosed and described with reference to a limited number of embodiments, it will be apparent that variations and modifications may be made thereto without departure from the spirit and scope of the invention and various other modifications may occur to those skilled in the art. Therefore, the following claims are intended to cover modifications, variations, and equivalents thereof.

What is claimed is:

1. A method of making a tool, said method comprising:

providing a pair of blade members and a tool body, each blade member being constructed of one or more metallic materials and having a backing portion and a cutting edge portion, the tool body comprising first and second elongated members, each elongated member constructed of a metallic material and having a handle portion at one end and a jaw portion at an opposite end, each jaw portion having one or more welding projections, intermediate portions of the elongated members being coupled to one another for movement about a pivot axis such that movement of the handle portions from an open position to a closed position moves the jaw portions from an open position in which the jaw portions are relatively far apart from one another to a closed position in which the jaw portions are relatively close to one another and movement of the handle portions toward their open position moves the jaw portions away from one another; and welding each of the blade members to the associated jaw portion of the associated elongated member by (a) placing each blade member in contact with the projection on the respective jaw portion and (b) applying electrical current and force to the tool body and the blade members, the applied electrical current flowing through each projection and the associated blade member and establishing a sufficient current density in each projection to heat each projection sufficiently to cause the metallic material of each projection to soften, the force moving each blade member and softened metallic material from each projection toward the associated jaw portion thereby forming a welded connection between each blade member and a respective jaw portion of the tool body, wherein the backing portion of each of the blade members contains a relatively lower amount of carbon in comparison with the amount of carbon in the cutting edge portion of the blade members.

2. A method according to claim 1, wherein each jaw portion of the tool body includes a slot sized to receive a respective blade member, each projection on each jaw portion being disposed within the slot formed therein, said welding further comprising (a) placing each blade member such that each blade member is in contact with each projection on a respective jaw portion as aforesaid and is aligned with a respective slot, and (b) moving each blade member and softened metallic material of each projection into the associated slot so that each blade member is disposed within a respective slot when a welded connection is formed between each blade member and the respective jaw portion.

3. A method according to claim 1, said jaw portion of each elongated member of said tool body having a gripping surface constructed and arranged such that when the jaw portions are in an open position the gripping surfaces are relatively far apart from one another and when the jaw portions are in their closed position the gripping surfaces are relatively close to one another to enable the gripping surfaces to apply generally opposing gripping forces to a workpiece by positioning the workpiece between the gripping surfaces when the jaw portions are in their open position and moving the jaw portions toward their closed position.

4. A method according to claim 1, said placing each blade member in contact with each projection on a respective jaw portion further comprising placing the blade members on the jaw portions so that the cutting edges of the blade members extend radially with respect to the pivot axis so that the cutting edges extend radially with respect to the pivot axis after formation of the welded connections between the blade members and the respective jaw portions.

5. A method according to claim 1, said placing each blade member in contact with each projection on a respective jaw portion further comprising placing the blade members on said projections when said jaw portions are in their closed position.

6. A method according to claim 5, said placing each blade member further comprising placing the blade members on the projections so that the cutting edges of the blade members are in abutting relation with one another so that said cutting edges are in abutting relation to one another when the jaw portions are in their closed position after weld formation.

7. A method according to claim 6, said applying force to the tool body and the blade members further comprising applying force to both blade members simultaneously so that the blade members move toward the jaw portions simultaneously.

8. A method according to claim 7, wherein the electrical current is applied by first and second electrodes, the first electrode being in contact with each blade member and the second electrode being in contact with the tool body, the first electrode being operable to apply force to the blade members and to move each blade member toward an associated jaw portion as aforesaid such that the cutting edges remain in abutting engagement as the welded connections are being formed.

9. A method according to claim 1, wherein after said welded connections are formed, a second electrical current is applied to each welded connection to temper each welded connection.

10. A method according to claim 9, wherein each welded connection is quenched for a period of time, and wherein after said quenching, a third electrical current is applied to each welded connection to temper each welded connection.

11. A method according to claim 1, wherein the cutting edge of each blade member has hardness of approximate 60 HRC and wherein each welded connection is tempered to approximately 45 HRC.

12. A method according to claim 1, wherein the cutting edges of the blade members are disposed in abutting relation to one another when the jaw portions are in their closed position.

13. A method according to claim 1, said rigidly securing a blade member in each slot further comprising, prior to said applying electrical current and force, placing a layer of metallic material between each associated blade member and the projections on the associated jaw portion, the metallic material of each layer of material having a lower melting point and a higher resistance to electrical current than the metallic material of the elongated member and the metallic material of the blade members and the metallic material of the each layer being metallurgically compatible with the metallic material of the elongated members and the metallic material of the blades, said applying electrical current and force further comprising applying electrical current such that the electrical current flows through each projection, through each layer of metallic material and through the associated blade member, the electrical current having a density sufficient to cause the metallic material of each projection and the metallic material of each layer of metallic material to soften and the force moving each blade member and softened metallic material from each projection and each layer toward the associated jaw portion thereby forming a welded connection between each blade member and a respective jaw portion of the tool body.

14. A method according to claim 13, wherein each jaw portion of the tool body includes a slot, each projection on each jaw portion being disposed within the slot formed therein, said welding further comprising (a) placing each blade member and each layer in a respective slot such that a layer of material is positioned between each blade member each projection within the associated slot on a respective jaw portion, and (b) moving each blade member and softened metallic material of each projection and each layer into the associated slot so that each blade member is disposed within a respective slot when a welded connection is formed between each blade member and the respective jaw portion.

15. A method according to claim 13, wherein each layer comprises a metallic material selected from a group consisting of stainless steel, Inconel and copper, and wherein each layer of metallic material has a thickness of between approximately 0.001 inch and 0.020 inch.

16. A method according to claim 1, wherein one of the blade members is in the form of a knife blade having a cutting edge and the other of the blade members is in the form of an anvil having a ramped surface, the knife blade being offset from the ramped surface of the anvil such that when the jaw portions are in their closed position, the cutting edge of the knife blade is relatively close to the ramped surface of the anvil and light cannot pass therethrough because the cutting edge of the knife blade is masked by the ramped surface of the anvil.

17. A method according to claim 1, wherein one of the blade members is in the form of a knife blade having a cutting edge and the other of the blade members is in the form of an anvil having a concave arcuate surface, the cutting edge of the knife blade being relatively close to the concave arcuate surface of the anvil when the jaw portions are in their closed position such that light cannot pass therethrough because the cutting edge of the knife blade is masked by the concave arcuate surface of the anvil.

18. A method according to claim 1, wherein each jaw portion includes a sloped surface that extends generally upwardly and outwardly from the blade member, the sloped surface being configured to guide scrap material from a workpiece being cut away from the blade members such that the scrap material can easily fall away from the tool.

19. A method of making a tool, said method comprising, forming first and second elongated longitudinal members, each member being an integral structure constructed of a metallic material and having a handle portion at one end and a jaw portion at an opposite end, each jaw portion having a gripping surface;

forming a longitudinal tool body by connecting intermediate portions of the elongated members to one another for pivotal movement about a pivot axis such that movement of the handle portions from an open position to a closed position moves the jaw portions from an open position in which the gripping surfaces are relatively far apart from one another to a closed position in which the gripping surfaces are relatively close to one another and movement of the handle portions toward their open position moves the jaw portions away from one another, the connected elongated members being constructed and arranged to enable the gripping surfaces to apply generally opposing gripping forces to a workpiece by positioning the workpiece between the gripping surfaces when the jaw portions are in their open position and moving the jaw portions toward their closed position;

forming a substantially continuous transverse slot that extends from one side of the tool body to an opposite side of the tool body when the jaw portions are in their closed position, the substantially continuous slot comprising a transverse slot formed in each jaw portion, the slot in each jaw portion extending from one side of an associated jaw portion to an opposite side of an associated jaw portion and the slots in the jaw portions being transversely aligned with one another to form the substantially continuous slot in the tool body, the slot in each jaw portion including one or more integral projections;

providing a pair of blade members, each blade member having a cutting edge portion providing a cutting edge, each blade member being constructed of one or more metallic materials;

welding a blade member to the jaw portion of each elongated member by (a) placing each blade member in contact with each projection on a respective jaw portion and (b) applying electrical current and force to the tool body and the blade members, the applied electrical current flowing through each projection and the associated blade member and establishing a sufficient current density in each projection to heat each projection sufficiently to cause the metallic material of each projection to soften and the force moving each blade member and softened metallic material from each projection toward the associated jaw portion and into a respective slot thereby forming a welded connection between each blade member and a respective jaw portion of the tool body, each blade member being welded to a respective jaw portion such that when the jaw portions are in their open position, the cutting edges of the blade members are spaced apart from one another and such that when the jaw portions are in their closed position, the cutting edges of the blade members are relatively close to one another, wherein a first portion of each of the blade members contains a relatively lower amount of carbon and a second portion of each of the blade members contains a relatively higher amount of carbon in comparison with the first portion.

20. A method according to claim 19, said placing each blade member in contact with each projection on a respective jaw portion further comprising placing the blade members on the jaw portions so that the cutting edges of the blade members extend radially with respect to the pivot axis so that the cutting edges extend radially with respect to the pivot axis after formation of the welded connections between the blade members and the respective jaw portions.

21. A method according to claim 19, said placing each blade member in contact with each projection on a respective jaw portion further comprising placing the blade members on said projections when said jaw portions are in their closed position.

22. A method according to claim 21, said placing each blade member further comprising placing the blade members on the projections so that the cutting edges of the blade members are in abutting relation to one another and said applying force to the tool body and the blade members further comprising moving the blade members toward the associated jaw portion simultaneously so that after weld formation, the cutting edges of the blade members are in abutting relation to one another when the jaw portions are in their closed position.

23. A method according to claim 22, wherein the electrical current is applied by first and second electrodes, the first electrode being in contact with each blade member and the second electrode being in contact with the tool body, the first electrode being operable to apply force to the blade members and to move the blade members simultaneously toward the respective jaw portions as aforesaid so that the cutting edges remain in abutting engagement with one another as the blade members move toward the tool body and as the welded connections are being formed.

24. A method according to claim 19, wherein after the welded connections are formed, a second electrical current is applied to each welded connection to temper each welded connection.

25. A method according to claim 24, wherein each welded connection is quenched for a period of time, and wherein after said quenching, a third electrical current is applied to each welded connection to temper each welded connection.

26. A method according to claim 25, wherein the projections are of approximately equal size to one another and wherein each said projection has a triangular cross-section.

27. A method according to claim 26, wherein the force applied to each blade member is between approximately 3500 pounds and approximately 5000 pounds per linear inch of height of each triangular projection.

28. A method according to claim 19, said rigidly securing a blade member in each slot further comprising, prior to said applying electrical current and force, placing a sheet of metallic material between each associated blade member and the projections on the associated jaw portion, the metallic material of each sheet of material having a lower melting point and a higher resistance to electrical current than the metallic material of the elongated member and the metallic material of the blade members and the metallic material of the each sheet being metallurgically compatible with the metallic material of the elongated members and the metallic material of the blades, said applying electrical current and force further comprising applying electrical current such that the electrical current flows through each projection, through each sheet of metallic material and through the associated blade member, the electrical current having a density sufficient to cause the metallic material of each projection and the metallic material of each sheet of metallic material to soften and the force moving each blade member and softened metallic material from each projection and each sheet toward the associated jaw portion thereby forming a welded connection between each blade member and a respective jaw portion of the tool body.

29. A method according to claim 28, wherein each sheet is comprised of a metallic material selected from a group consisting of stainless steel, Inconel and copper.

30. A method according to claim 19, wherein one of the blade members is in the form of a knife blade having a cutting edge and the other of the blade members is in the form of an anvil having a ramped surface, the knife blade being offset from the ramped surface of the anvil such that when the jaw portions are in their closed position, the cutting edge of the knife blade is relatively close to the ramped surface of the anvil and light cannot pass therethrough because the cutting edge of the knife blade is masked by the ramped surface of the anvil.

31. A method according to claim 19, wherein one of the blade members is in the form of a knife blade having a cutting edge and the other of the blade members is in the form of an anvil having a concave arcuate surface, the cutting edge of the knife blade being relatively close to the concave arcuate surface of the anvil when the jaw portions are in their closed position such that light cannot pass therethrough because the cutting edge of the knife blade is masked by the concave arcuate surface of the anvil.

32. A method according to claim 19, wherein each jaw portion includes a sloped surface that extends generally upwardly and outwardly from the blade member, the sloped surface being configured to guide scrap material from a workpiece being cut away from the blade members such that the scrap material can easily fall away from the tool.

33. A method of making a tool, said method comprising:

providing a pair of blade members and a tool body, each blade member being constructed of one or more metallic materials and having a cutting edge, the tool body comprising a pair of first and second elongated members, each member being an integral structure constructed of a metallic material and having a handle portion at one end and ajaw portion at an opposite end, each jaw portion having a gripping surface and one or more welding projections, intermediate portions of the elongated members being coupled to one another for movement about a pivot axis such that movement of the handle portions from an open position to a closed position moves the jaw portions from an open position in which the gripping surfaces are relatively far apart from one another to a closed position in which the gripping surfaces are relatively close to one another and movement of the handle portions toward their open position moves the gripping surfaces away from one another to enable the gripping surfaces to apply generally opposing gripping forces to a workpiece by positioning the workpiece between the gripping surfaces when the jaw portions are in their open position and moving the jaw portions toward their closed position;

welding a blade member to the jaw portion of each elongated member by (a) placing the jaw portions of the tool body in their closed position, (b) positioning the blade members such that each blade member is in contact with each projection on a respective jaw portion and (c) applying electrical current and force to the tool body and the blade members, the electrical current being applied utilizing a first electrode in contact with the blade members and a second electrode in contact with the tool body, the applied electrical current flowing through each projection and the associated blade member and establishing a sufficient current density in each projection to cause the metallic material of each projection to soften and the force being applied utilizing the first electrode, the first electrode being configured and operable to move each blade member and metallic material from each projection toward the associated jaw portion thereby forming a welded connection between each blade member and a respective jaw portion of the tool body and to align the cutting edges of the blade members with one another as each welded connection is formed so that when the jaw portions are in their closed position, the cutting edges of the blade members are aligned with one another.

34. A method according to claim 33, said positioning further comprising positioning the blade members such that the cutting edges of the blade members are in abutting relation to one another and wherein the first electrode is further configured and operable to maintain the cutting edges of the blade members in abutting relation with one another as each welded connection is formed so that when the jaw portions are in their closed position after weld formation, the cutting edges of the blade members are in abutting relation with one another.

35. A method according to claim 33, wherein one of the blade members is in the form of a knife blade having a cutting edge and the other of the blade members is in the form of an anvil having a ramped surface, the knife blade being offset from the ramped surface of the anvil such that when the jaw portions are in their closed position, the cutting edge of the knife blade is relatively close to the ramped surface of the anvil and light cannot pass therethrough because the cutting edge of the knife blade is masked by the ramped surface of the anvil.

36. A method according to claim 33, wherein one of the blade members is in the form of a knife blade having a cutting edge and the other of the blade members is in the form of an anvil having a concave arcuate surface, the cutting edge of the knife blade being relatively close to the concave arcuate surface of the anvil when the jaw portions are in their closed position such that light cannot pass therethrough because the cutting edge of the knife blade is masked by the concave arcuate surface of the anvil.

37. A method according to claim 33, wherein each jaw portion includes a sloped surface that extends generally upwardly and outwardly from the blade member, the sloped surface being configured to guide scrap material from a workpiece being cut away from the blade members such that the scrap material can easily fall away from the tool.

38. A method of welding a workpiece engaging structure to a tool body, the workpiece engaging structure being constructed of at least one metallic material, the method comprising:

providing the workpiece engaging structure, the workpiece engaging structure comprising a workpiece engaging portion containing a relatively higher amount of carbon and a backing portion containing a relatively lower amount of carbon, the workpiece engaging portion being joined with the backing portion;

providing the tool body, the tool body being constructed of a relatively softer metallic material and having one or more projections projecting integrally outwardly from a surface thereof;

placing the backing portion of the workpiece engaging structure in contact with each projection on the tool body;

applying electrical current and force to the tool body and the workpiece engaging structure, the applied electrical current flowing between the tool body and the workpiece engaging structure through each projection and establishing a sufficient current density in each projection to heat each projection sufficiently to cause the metallic material of each projection to soften, each projection and the workpiece engaging structure being constructed and arranged such that the applied electrical current heats the projections sufficiently to soften the metallic material of each projection without heating the workpiece engaging portion of the workpiece engaging structure to a degree that would substantially affect the hardness of the workpiece engaging portion of the workpiece engaging structure; and applying a force to the workpiece engaging structure and tool body such that the softened metallic material of each projection forms a welded connection between the workpiece engaging structure and the tool body, wherein the workpiece engaging structure includes a first portion containing a relatively lower amount of carbon and a second portion containing a relatively higher amount of carbon in comparison with the first portion.

39. A method according to claim 38, wherein the metallic material of the backing portion of the workpiece engaging structure has a lesser degree of hardness than the metallic material of the workpiece engaging portion of the workpiece engaging structure.

40. A method according to claim 39, wherein the workpiece engaging structure is a blade member and the workpiece engaging portion thereof provides a cutting edge portion of the blade member.

41. A method according to claim 40, wherein the metallic material used to construct said cutting edge portion of each the blade member is a highly alloyed steel.

42. A method according to claim 40, wherein the metallic material of the cutting edge portion of each blade member is coated with a coating material capable of increasing the hardness and/or the lubricity of each said cutting edge portion.

43. A tool for working on a workpiece, said tool comprising:

a longitudinal tool body comprising first and second elongated longitudinal members, each member being constructed of a metallic material and each having a handle portion at one end and a jaw portion at an opposite end;

intermediate portions of said first and second members being movably coupled to one another for pivotal movement about a pivot axis such that movement of said handle portions from an open position in which said handle portions are relatively far apart from one another to a closed position in which said handle portions are relatively close to one another moves said jaw portions from an open position in which said jaw portions are spaced relatively far apart from one another to a closed position in which said jaw portions are relatively close to one another and such that movement of said handle portions away from one another moves said jaw portions away from one another, each jaw portion having a gripping surface configured such that when said jaw portions are in an open position, said gripping surfaces are relatively far apart from one another to enable a workpiece to be positioned therebetween and such that when said jaw portions are in their closed position said gripping surfaces are relatively close one another, the tool body being constructed and arranged to enable said gripping surfaces to apply generally opposing gripping forces to a workpiece by positioning the workpiece between said gripping surfaces when said jaw portions are in their open position and moving said jaw portions toward their closed position;

each jaw portion including a slot extending from one side of an associated jaw portion to an opposite side of an associated jaw portion, each slot having a pair of open opposite ends, said slots being constructed and arranged such that when said jaw portions are in their closed position, said slots are transversely aligned with one another and cooperate with one another to form a substantially continuous transverse slot that extends from one side of the tool body to an opposite side of the tool body; and a pair of separate blade members, each blade member having a cutting edge portion providing a cutting edge that is radially aligned with said pivot axis and is constructed of a metallic material that is harder than the metallic material used to construct said elongated members, each blade member being rigidly secured within a respective one of said slots such that (a) when said jaw portions are in their closed position, said cutting edges are relatively close to one another, such that (b) when said jaw portions are in their open position said cutting edges are spaced relatively far apart from one another to enable a workpiece to be positioned therebetween, and (c) such that when a workpiece is positioned between said cutting edges and said jaw portions are moved toward their closed position, said cutting edges cut the workpiece, wherein one of the blade members is in the form of a knife blade having a cutting edge and the other of the blade members is in the form of an anvil having a ramped surface, the knife blade being offset from the ramped surface of the anvil such that when the jaw portions are in their closed position, the cutting edge of the knife blade is relatively close to the ramped surface of the anvil and light cannot pass therethrough because the cutting edge of the knife blade is masked by the ramped surface of the anvil, and wherein the cutting edge portions contain a relatively higher amount of carbon and other portions of the blade members contain a relatively lower amount of carbon in comparison with the cutting edge portions.

44. A tool for working on a workpiece, said tool comprising:

a longitudinal tool body comprising first and second elongated longitudinal members, each member being constructed of a metallic material and each having a handle portion at one end and ajaw portion at an opposite end;

intermediate portions of said first and second members being movably coupled to one another for pivotal movement about a pivot axis such that movement of said handle portions from an open position in which said handle portions are relatively far apart from one another to a closed position in which said handle portions are relatively close to one another moves said jaw portions from an open position in which said jaw portions are spaced relatively far apart from one another to a closed position in which said jaw portions are relatively close to one another and such that movement of said handle portions away from one another moves said jaw portions away from one another, each jaw portion having a gripping surface configured such that when said jaw portions are in an open position, said gripping surfaces are relatively far apart from one another to enable a workpiece to be positioned therebetween and such that when said jaw portions are in their closed position said gripping surfaces are relatively close one another, the tool body being constructed and arranged to enable said gripping surfaces to apply generally opposing gripping forces to a workpiece by positioning the workpiece between said gripping surfaces when said jaw portions are in their open position and moving said jaw portions toward their closed position;

each jaw portion including a slot extending from one side of an associated jaw portion to an opposite side of an associated jaw portion, each slot having a pair of open opposite ends, said slots being constructed and arranged such that when said jaw portions are in their closed position, said slots are transversely aligned with one another and cooperate with one another to form a substantially continuous transverse slot that extends from one side of the tool body to an opposite side of the tool body; and a pair of separate blade members, each blade member having a cutting edge portion providing a cutting edge that is radially aligned with said pivot axis and is constructed of a metallic material that is harder than the metallic material used to construct said elongated members, each blade member being rigidly secured within a respective one of said slots such that (a) when said jaw portions are in their closed position, said cutting edges are relatively close to one another, such that (b) when said jaw portions are in their open position said cutting edges are spaced relatively far apart from one another to enable a workpiece to be positioned therebetween, and (c) such that when a workpiece is positioned between said cutting edges and said jaw portions are moved toward their closed position, said cutting edges cut the workpiece, wherein one of the blade members is in the form of a knife blade having a cutting edge and the other of the blade members is in the form of an anvil having a concave arcuate surface, the cutting edge of the knife blade being relatively close to the concave arcuate surface of the anvil when the jaw portions are in their closed position such that light cannot pass therethrough because the cutting edge of the knife blade is masked by the concave arcuate surface of the anvil, and wherein the cutting edge portions contain a relatively higher amount of carbon and other portions of the blade members contain a relatively lower amount of carbon in comparison with the cutting edge portions.

45. A tool for working on a workpiece, said tool comprising:

a longitudinal tool body comprising first and second elongated longitudinal members, each member being constructed of a metallic material and each having a handle portion at one end and a jaw portion at an opposite end;

intermediate portions of said first and second members being movably coupled to one another for pivotal movement about a pivot axis such that movement of said handle portions from an open position in which said handle portions are relatively far apart from one another to a closed position in which said handle portions are relatively close to one another moves said jaw portions from an open position in which said jaw portions are spaced relatively far apart from one another to a closed position in which said jaw portions are relatively close to one another and such that movement of said handle portions away from one another moves said jaw portions away from one another, each jaw portion having a gripping surface configured such that when said jaw portions are in an open position, said gripping surfaces are relatively far apart from one another to enable a workpiece to be positioned therebetween and such that when said jaw portions are in their closed position said gripping surfaces are relatively close one another, the tool body being constructed and arranged to enable said gripping surfaces to apply generally opposing gripping forces to a workpiece by positioning the workpiece between said gripping surfaces when said jaw portions are in their open position and moving said jaw portions toward their closed position;

each jaw portion including a slot extending from one side of an associated jaw portion to an opposite side of an associated jaw portion, each slot having a pair of open opposite ends, said slots being constructed and arranged such that when said jaw portions are in their closed position, said slots are transversely aligned with one another and cooperate with one another to form a substantially continuous transverse slot that extends from one side of the tool body to an opposite side of the tool body; and a pair of separate blade members, each blade member having a cutting edge portion providing a cutting edge that is radially aligned with said pivot axis and is constructed of a metallic material that is harder than the metallic material used to construct said elongated members, each blade member being rigidly secured within a respective one of said slots such that (a) when said jaw portions are in their closed position, said cutting edges are relatively close to one another, such that (b) when said jaw portions are in their open position said cutting edges are spaced relatively far apart from one another to enable a workpiece to be positioned therebetween, and (c) such that when a workpiece is positioned between said cutting edges and said jaw portions are moved toward their closed position, said cutting edges cut the workpiece, wherein each jaw portion includes a sloped surface that extends generally upwardly and outwardly from the blade member, the sloped surface being configured to guide scrap material from a workpiece being cut away from the blade members such that the scrap material can easily fall away from the tool, and wherein the cutting edge portions contain a relatively higher amount of carbon and other portions of the blade members contain a relatively lower amount of carbon in comparison with the cutting edge portions.

* * * * *